US012188141B2

(12) United States Patent
Jastrzebski

(10) Patent No.: US 12,188,141 B2
(45) Date of Patent: Jan. 7, 2025

(54) ELECTROWINNING CELL FOR THE PRODUCTION OF LITHIUM AND METHOD OF USING SAME

(71) Applicant: LI-Metal Corp., Markham (CA)

(72) Inventor: Maciej Jastrzebski, Markham (CA)

(73) Assignee: Arcadium Lithium Intermediate IRL Limited, Shannon (IE)

( * ) Notice: Subject to any disclaimer, the term of this patent is extended or adjusted under 35 U.S.C. 154(b) by 0 days.

(21) Appl. No.: 18/068,128

(22) Filed: Dec. 19, 2022

(65) Prior Publication Data

US 2023/0119799 A1 Apr. 20, 2023

Related U.S. Application Data

(63) Continuation of application No. PCT/CA2022/050093, filed on Jan. 21, 2022.
(Continued)

(51) Int. Cl.
*C25C 7/00* (2006.01)
*C25C 1/22* (2006.01)
(Continued)

(52) U.S. Cl.
CPC ..... *C25C 7/00* (2013.01); *C25C 1/22* (2013.01); *C25C 3/02* (2013.01); *C25C 7/04* (2013.01); *C25C 7/06* (2013.01)

(58) Field of Classification Search
CPC ..... C25C 3/02
(Continued)

(56) References Cited

U.S. PATENT DOCUMENTS 1,501,756 A * 7/1924 Downs ..... C25C 3/02 205/411
2,924,558 A * 2/1960 Gallinger ..... C25C 7/04 204/260
(Continued)

FOREIGN PATENT DOCUMENTS

CA 2242421 8/1997
CA 3010198 A1 7/2017
(Continued)

OTHER PUBLICATIONS

The International Search Report and Written Opinion dated Apr. 21, 2022 for PCT/CA2022/050093.
(Continued)

*Primary Examiner* — Harry D Wilkins, III
(74) *Attorney, Agent, or Firm* — Williams Mullen; F. Michael Sajovec

(57) ABSTRACT

A process for electrowinning a metal using a flow-through electrowinning apparatus can include the steps of: a) conveying an anolyte material and a metal chemical feedstock material along an anolyte flow path within an anolyte chamber; b) conveying catholyte material along a catholyte flow path within a catholyte chamber that has a cathode; c) applying an activation electric potential between the anode and a cathode that is sufficient to electrolyze and liberate metal ions from the metal chemical feedstock material in the anolyte chamber, thereby causing a flux of metal ions to migrate through a porous membrane from the anolyte chamber to the catholyte chamber and a metal product to be formed in the catholyte chamber; and while applying the activation electric potential, extracting a feedstock-depleted anolyte material from the anolyte chamber; and extracting an outlet material comprising the catholyte material and the
(Continued)

metal product from the catholyte chamber via a catholyte outlet.

19 Claims, 15 Drawing Sheets

Related U.S. Application Data

(60) Provisional application No. 63/140,119, filed on Jan. 21, 2021, provisional application No. 63/140,149, filed on Jan. 21, 2021.

(51) Int. Cl.
*C25C 3/02* (2006.01)
*C25C 7/04* (2006.01)
*C25C 7/06* (2006.01)

(58) Field of Classification Search
USPC ..... 205/407; 204/260
See application file for complete search history.

(56) References Cited

U.S. PATENT DOCUMENTS 3,111,745 A * 11/1963 Carlisle ..... C25C 7/005 204/260
3,408,282 A 10/1968 Frank
3,607,684 A * 9/1971 Kuhn ..... C25C 7/04 205/411
3,962,064 A * 6/1976 Brut ..... C25C 7/005 205/407
4,089,770 A * 5/1978 Lemke ..... C25C 7/005 205/407
4,092,228 A * 5/1978 Ross ..... C25C 7/005 205/406
4,107,743 A 8/1978 Mestdagh
4,108,743 A 8/1978 Minck
4,156,635 A 5/1979 Cooper
4,186,049 A 1/1980 Blum
4,256,551 A * 3/1981 Cliff ..... C25B 1/00 205/531
4,455,202 A * 6/1984 Sintim-Damoa ..... C25C 3/02 205/407
4,592,821 A 6/1986 Keinborg
4,617,098 A * 10/1986 Verdier ..... C25C 3/02 205/411
4,740,279 A * 4/1988 Muller ..... C25C 3/02 204/247
4,780,186 A * 10/1988 Christini ..... C25C 3/02 205/407
4,790,917 A * 12/1988 Dewing ..... C25C 3/02 205/705
4,849,072 A * 7/1989 Bowman ..... C25C 3/02 205/407
4,882,017 A 11/1989 Weaver
4,973,390 A * 11/1990 Christini ..... C25C 7/005 204/279
4,988,417 A * 1/1991 DeYoung ..... C25C 7/04 204/243.1
5,131,988 A * 7/1992 Peterson ..... C01D 15/04 75/690
5,650,053 A 7/1997 Gay
5,951,843 A * 9/1999 Itoh ..... C25C 3/02 204/263
6,063,247 A 5/2000 Bergmann
6,086,733 A * 7/2000 Carey ..... C02F 1/46109 204/263
6,368,486 B1 * 4/2002 Thompson ..... C25C 7/02 205/406
6,368,487 B1 4/2002 Huber
6,730,210 B2 5/2004 Thompson
7,897,023 B2 3/2011 Bakhir et al.
8,715,482 B2 5/2014 Amendola
11,174,562 B2 11/2021 But
2003/0094379 A1 * 5/2003 Jacobson ..... C25C 1/02 205/406
2004/0111874 A1 * 6/2004 Schierle-Arndt ..... C25C 3/02 252/62.2
2004/0194574 A1 10/2004 Cardarelli
2005/0100793 A1 * 5/2005 Jonghe ..... C25C 1/02 429/246
2006/0144701 A1 7/2006 Kelly
2007/0246368 A1 10/2007 Huber
2008/0054629 A1 3/2008 Sawanura
2010/0084265 A1 4/2010 Lee
2011/0135565 A1 * 6/2011 Bingham ..... C01B 3/06 423/657
2012/0006690 A1 * 1/2012 Amendola ..... C25C 7/08 205/407
2012/0241314 A1 9/2012 Madono et al.
2013/0001097 A1 1/2013 Nakamura
2014/0131217 A1 5/2014 Buschmann
2015/0014184 A1 * 1/2015 Swonger ..... C25C 7/007 204/252
2015/0041311 A1 * 2/2015 Mathe ..... C02F 1/4674 204/260
2015/0064568 A1 3/2015 Yushin
2015/0129432 A1 5/2015 Wright et al.
2015/0211135 A1 7/2015 Fan
2016/0251764 A1 9/2016 Iltsenko
2018/0187317 A1 7/2018 Gordon
2019/0048483 A1 2/2019 Swonger et al.
2020/0181783 A1 6/2020 But
2020/0399772 A1 12/2020 Kiggins
2022/0267918 A1 8/2022 Jastrzebski
2023/0167565 A1 6/2023 Jastrzebski
2023/0183875 A1 6/2023 Jastrzebski
2023/0203689 A1 6/2023 Jastrzebski
2023/0349061 A1 11/2023 Jastrzebski

FOREIGN PATENT DOCUMENTS

CN 101356668 1/2009
GB 1024689 3/1966
RU 20088105197 8/2009
WO 1993010281 5/1993
WO 2014152393 A1 9/2014
WO 2019219821 11/2019
WO 2021012055 1/2021

OTHER PUBLICATIONS

Sekiguchi et al, Thermodynamic analysis of molten alkali halide mixtures by molecular dynamic simulations, Journal of Molecular Liquids, vol. 315, Oct. 2020, 113758 pp. 1-7 (Year 2020).
Xin Zhang, Aiguo Han and Yongan Yang, "Review on the production of high-purity lithium metal", J. Mater. Chem. A, 2020,8, 22455-22466.
Office action issued by CIPO on Dec. 11, 2023 in relation to CA 3,183,962.
European Search Report issued Jan. 4, 2024 in respect of EP 40004260.
The International Search Report and Written Opinion dated May 3, 2022 for PCT/CA2022/050092.
Sridharan et al, Thermal Properties of LiCl—KCl Molten Salt for Nuclear Waste Separation, OSTI.gov Technical Report, available online at https://www.osti.gov/biblio/1058922, Nov. 2012, pp. 1-111 (Year: 2012).
The International Search Report and Written Opinion dated Apr. 14, 2022 for PCT/CA2022/050095.
William H. Kruesi et al., "The Electrowinning of Lithium from Chloride-Carbonate Melts", Metallurgical Transactions B, vol. 24B, Aug. 1993-605.
Lukasko J.J and Murphy J. E., "Electrolytic Production of Calcium Metal", Report of Investigations/ 1990.
Office Action issued on CA 3,183,962 on Jan. 25, 2023.
Office action issued on CA 3,183,962 on Dec. 11, 2023.

(56) References Cited

OTHER PUBLICATIONS

International search report and written opinion for international application No. PCt/CA2020/051021 mailed Oct. 5, 2020.
Office action issued in CN202080053142 on Apr. 7, 2024.
European Search Report issued Jan. 4, 2024 in relation to EP 2084442.2.
International Search Report for PCT/CA2020/051021 dated Sep. 8, 2020.
European Search Report issued for EP application No. 20844442.2, mailed Dec. 8, 2023.

* cited by examiner

ELECTROWINNING CELL FOR THE PRODUCTION OF LITHIUM AND METHOD OF USING SAME

CROSS-REFERENCE TO RELATED APPLICATIONS

The present application is a continuation of international patent application no. PCT/CA2022/050093 filed Jan. 21, 2022 and entitled Electrowinning Cell For The Production Of A Metal Product And Method Of Using Same, which claims priority to, and the benefit of, U.S. provisional application No. 63/140,119 filed Jan. 21, 2021 and entitled Process for Production Refined Lithium Metal and U.S. provisional application No. 63/140,149 filed Jan. 21, 2021 and entitled Electrowinning Cell for the Production of Lithium and Method of Using Same, the entirety of these applications being incorporated herein by reference.

FIELD OF THE INVENTION

In one of its aspects, the present invention relates to a flow-through, porous membrane electrowinning apparatus that can be used to produce a target metal product from a corresponding target metal feedstock material. The target metal product that is produced in the apparatus can be a target metal or an alloy containing the target metal. The target metal may be lithium from and the feedstock may be a lithium chemical feed stock material.

INTRODUCTION

Molten salt electrolysis has been widely practiced for over a hundred years, including the Hall-Heroult process for aluminum, the Dow and IG Farben processes for magnesium, and the Downs process for alkali metals. The majority of commercial-scale molten salt electrolytic processes use chloride or fluoride electrolytes, as these are solvents which facilitate the electrowinning of the target metals from their oxides, chlorides, or other compounds. In many cases, the electrolyte, or the oxide, chloride, or fluoride of the desired product metal, have either physical properties that are undesirable (e.g., toxic, hygroscopic, corrosive, etc.) or are disadvantageous for other reasons (cost, availability, security of supply, competing uses, difficulty of manufacture, etc.).

U.S. Pat. No. 3,607,684 discloses a process for the manufacture of alkali metal by passing an electrolyzing current from an anode to a cathode. The anode is in contact with a fused metal halide salt comprising ions of the alkali metal and no other monovalent cations. The cathode is in the form of liquid alkali metal. Interspersed between the anode and the cathode is a diaphragm. The diaphragm is polycrystalline ceramic material which has ions of the alkali metal or ions capable of being replaced by the alkali metal. The diaphragm is permeable only to monovalent cations and therefore will pass only the cations of the alkali metal which is being manufactured. Halogen can be recovered as the anode product or a halogenated hydrocarbon can be recovered as the anode product by introducing a hydrocarbon or partially halogenated hydrocarbon into the anode compartment.

U.S. Pat. No. 1,501,756 discloses a process of producing alkali metals and halogens by electrolysis of fused halide baths, as for example, sodium chloride. An object of the invention is to recover halogens containing practically no gaseous impurities.

U.S. Pat. No. 4,988,417 discloses a method of electrolytically producing lithium includes providing an electrolytic cell having an anode compartment and a cathode compartment. The compartments are separated by a porous electrically nonconductive membrane which will be wetted by the electrolyte and permit migration of lithium ions therethrough. Lithium carbonate is introduced into the anode compartment and produces delivery of lithium ions from the anode compartment to the cathode compartment where such ions are converted into lithium metal. The membrane is preferably a non-glass oxide membrane such as a magnesium oxide membrane. The membrane serves to resist undesired backflow of the lithium from the cathode compartment through the membrane into the anode compartment. Undesired communication between the anode and cathode is further resisted by separating the air spaces thereover. This may be accomplished by applying an inert gas purge and a positive pressure in the cathode compartment. The apparatus preferably includes an electrolytic cell with an anode compartment and a cathode compartment and an electrically nonconductive membrane which is wettable by the electrolyte and will permit migration of the lithium ion therethrough while resisting reverse passage of lithium therethrough.

SUMMARY

Lithium metal can be produced using a modified Downs cell (see, for example, U.S. Pat. Nos. 1,501,756 and 6,063,247) from a eutectic mixture of LiCl—KCl using a LiCl feed material. The Downs cell generally uses bottom-mounted graphite anodes and side-mounted cathodes in a refractory-lined cell, typically comprising four connected anode and cathode assemblies arranged in a known, "cloverleaf" pattern. Interposed between the anode and cathode is a metal mesh, which serves to separate the anode gases from the cathode product, thus limiting recombination of the two products.

Under the influence of sufficient potential, molten lithium metal plates out onto the cathode, while chlorine gas evolves at the anode, according to reaction 1 (below). The metal floats upwards where it is collected in an annular bell submerged in the electrolyte. The bell directs the molten metal out of the cell due to differential metallostatic head produced by the difference in density between the electrolyte and the metal. Chlorine gas evolves at the anode as a result of the electrolytic reaction and is captured above the anode. Back-reaction of the metallic and gaseous products is prevented by a wire mesh interposed between the two electrodes.

$$2LiCl(l)=2Li(l)+Cl_2(g);E^0=-3.609\ V \quad [1]$$

One of the drawbacks of the Downs process is that LiCl is hygroscopic, which makes its handling challenging and, even when well done, it can act as a source of water in the electrolytic cell. Water in a Downs cell has several negative consequences. Firstly, it reacts with the lithium chloride, making HCl and LiOH. LiOH has low solubility in the melt, which can cause it to form sludge and potentially results in lithium losses. Secondly, water attacks the graphite anodes, causing the anodes to oxidize and erode. This is problematic, because the anode in a Downs cell cannot be replaced without rebuilding the cell, which can increase direct costs and downtime/lost production. Thirdly, while dry chlorine gas can be handled in conventional materials, wet chlorine gas is highly corrosive to the interior of the cell and downstream equipment. This means that these components must be made of special corrosion-resistant steels, and even these do not necessarily have long life. This can have serious negative consequences for equipment availability. Another drawback of the Downs process may be that the relatively low quality of the chlorine gas produced means it has limited value as a by-product, and thus is generally treated as a toxic waste gas. This can impose additional costs on the operation of the Downs, thereby increasing the cost of the lithium product. In addition, because the LiCl required by the Downs process must be of high purity, it is often derived from high purity lithium carbonate. Conversion of lithium carbonate to LiCl is a costly process, requiring consumption of HCl and drying under vacuum. As a result, LiCl tends to be a costlier source of lithium feed material than lithium carbonate ($Li_2CO_3$).

In GB1024689, a method is described that attempts to reduce the reliance of the Downs process on LiCl feed. The method proposes feeding a small quantity of $Li_2CO_3$ directly into the anode compartment where it reacts in solid form with the evolved chlorine gas. This, however, may not be a practical approach, for several reasons. Firstly, because $Li_2CO_3$ is not an easily flowing bulk solid, it becomes sticky at the typical Downs cell operating temperatures. This means that gas permeability can be difficult to maintain, and a crust can form in due course, resulting in relatively poor conversion of the $Li_2CO_3$. Secondly, $Li_2CO_3$ reacts at the cathode with lithium metal, and is directly electrolyzed according to reactions 2 and 3 (below). This may cause reductions in current efficiency, elemental carbon sludge formation, and low-solubility $Li_2O$ formation whenever there is a mismatch between the feeding and consumption of $Li_2CO_3$. Such mismatches can occur for operational reasons, such as current setpoint changes, feed system lag, power fluctuations, or the aforementioned crusting. These challenges make the proposed method of GB1024689 difficult to adopt for the commercial production of lithium metal from $Li_2CO_3$.

$$4Li(l,s)+Li_2CO_3(l,s)=C(s)+3Li_2O(l,s) \quad [2]$$

$$3CO_3^{2-}(l)=2CO_2(g)+C(s)+3O^{2-}(l);E^0=\sim-2.5\ V \quad [3]$$

U.S. Pat. No. 4,988,417 describes a molten salt LiCl—KCl electrolytic process whereby lithium carbonate is fed into a cell with separate anolyte and catholyte compartments. The cell is separated by a porous ceramic membrane. According to the disclosure, the cell is intended to be operated between 550-770° C., with 5-10% $Li_2CO_3$ dissolved in the melt, while carbon anodes provide a source of carbon for the reduction reaction. Beneficially, the cell of the invention can produce relatively high purity lithium metal from lithium carbonate, according to equation 4, which has a lower decomposition potential than the conventional chloride reaction 1, thereby nominally reducing the energy consumption and cost thereof.

$$Li_2CO_3(s,l)+\tfrac{1}{2}C(s)=2Li(l)+3/2CO_2(g);E^0=-2.127\ V \quad [4]$$

While it is true that relying on reaction 4 reduces the decomposition potential of the lithium metal-producing reaction, there are a number of practical limitations that can negate this benefit. Porous membranes not only reduce diffusion, they also have substantially higher resistance to ionic condition. Typically, this can be 4-10 times higher than the electrolyte bath, meaning that membranes of a workable thickness can more than double the resistive losses due to the anode-to-cathode gap. Also, because the carbon anodes are consumed by the process, the electrical resistance of the anode-to-cathode gap increases over time, leading to further increases to the resistive losses as the anode wears.

One or more of these effects may be mitigated to some extent by operating at low current density, which generally lead to a low productivity per unit electrode area. This can be complemented by increasing the overall physical size of the electrolysis unit, and/or the number of cells required for a given production capacity, which can increase the capital cost and personnel costs of the plant.

Operation at low current density may also require a relatively larger membrane area, which may tend to increase carbonate transport between the anolyte and catholyte. This can result in reduced current efficiency and the production of elemental carbon sludge and $Li_2O$ build-up in the cathode compartment, further reducing the economic performance of the cell.

Another consequence of operating at low applied potential is that the process relies entirely on a carbon-consuming reaction. This can result in a high carbon consumption per unit of metal produced which, given the high cost of graphite, can increase the operating cost of the plant.

In "*The Electrowinning of Lithium from Chloride-Carbonate Melts*", Kruesi and Fray disclose a similar low-potential $Li_2CO_3$ electrolysis process to U.S. Pat. No. 4,988,417. Efforts are made to reduce carbon costs by employing a durable anode and a preferentially-consumed bed or slurry of low-cost carbon. Although most of the carbon anode approaches reported by Kruesi and Fray are successful at producing lithium metal, few do so with high current efficiency, and none achieve more than a modest reduction in carbon consumption. Also, because the work continues to use low applied potentials in an effort to realize energy savings, it is limited to low current-density operation.

Current electrolyzer technology has not been adapted to the membrane processes described above at industrially practical scale. With the Downs cell, its non-contiguous membrane and bottom-mounted anode make adaptation difficult. Replacing the steel mesh membrane with a porous membrane is not generally practical, as, for example, it would be difficult to ensure a leak-tight seal against the bottom of the vessel, thereby preventing effective separation of the anode and cathode compartments. Also, because the anodes are bottom mounted, the life of the vessel could be limited to less than a week or two before the anode would have to be replaced.

Hall-Heroult cells have been well developed for aluminum electrolysis with consumable anodes; however, these are designed for operation with a metal that is denser than the electrolyte and so are not suitable for the lithium production processes described herein.

While the Dow magnesium electrolyzer may be designed for both consumable anodes and metal with lower density than the electrolyte, it is generally impractical to provide feeding mechanisms that are capable of supplying each individual sub-compartment with $Li_2CO_3$, feed material while accommodating the anode mechanism, without unduly enlarging the anode-to-cathode distance and incurring the attendant resistive losses and heat balance problems. Additionally, an arrangement where each anode is in an independent compartment and the cathodes are in a common compartment leaves the electrolyzer vulnerable to membrane failure, as leakage in any single membrane contaminates all cathodes.

U.S. Pat. No. 3,607,684 discloses a membrane electrolyzer with a beta-alumina diaphragm and a solvent metal cathode. This process has drawbacks when used with $Li_2CO_3$, including that the proposed membranes are located on the bottom of the vessel in a "window pane" arrangement. Such an arrangement would be difficult to execute without leaks, given the substantial thermal expansion of components between assembly and operating temperatures. Also, it is known that molten alloys of lithium are relatively aggressive towards alumina, meaning that the membranes would be attacked by the flowing metal and any likely gasket materials, limiting the life of the electrolyzer substantially.

One improvement over conventional lithium production techniques can include the use of molten salt electrolysis and associated electrolyzers in the production of metals from oxide, chlorides, hydroxides, nitrate, sulfate, or carbonate compounds. One suitable molten salt electrolyzer apparatus and method is described international patent application no. PCT/CA2020/051021, which describes a containment vessel that is configured to contain a molten salt anolyte (and function as an anolyte chamber) and to have at least one electrode assembly and preferably having at least two electrode assemblies (each having an anode and a complimentary cathode) positioned within the containment vessel. Optionally, a single containment vessel (preferably with a single anolyte bath) may have 2 or more electrode assemblies (electrode pairs), and may have at least 3, 4, 5, 6, 7, 8, 9, 10, 11, 12, 13, 14, 15 or more electrode assemblies. In some preferred embodiments the containment vessel may include at least 10 electrode assemblies.

Such electrolyzer apparatuses are preferably configured such that the anodes are each directly submerged within the common, molten salt anolyte bath while each cathode is surrounded by a suitable cathode housing that includes a porous membrane to provide a respective, discrete catholyte compartment proximate each cathode. This can provide an apparatus that includes a common anolyte compartment in combination with a plurality of discrete catholyte compartments. That is, each cathode housing can be provided in any suitable structure, and may be formed from any suitable material, that can help separate the catholyte from the anolyte while still allowing a desired level of ion transfer between the anolyte compartment and catholyte compartments while the apparatus is in use to achieve the desired reactions and metal formation (e.g. the housings can be substantially leak-tight). Optionally, at least a portion of the cathode housing may be provided by a suitable membrane material, such as a substantially rigid and porous ceramic membrane that can maintain separation between the anolyte and catholyte while allowing a desired degree of ion transfer. Optionally, the entire cathode housing or at least substantially the entire cathode housing may be formed from the porous ceramic membrane, and the membrane may be generally continuous such that is covers the front, rear, side and bottom faces of the cathode.

However, when such an electrolyzer apparatus is used to produce lithium from chlorides, carbonates, hydroxides and oxides it can result in the production of various oxides around the cathodes and their respective membrane housings. Production of oxides can be especially severe in the case of highly-porous membranes and carbonate feedstocks, as the transport of carbonate into the cathode compartment allows back-reaction of carbonate with the lithium metal to produce lithium oxide and carbon. Over time, if the oxides remain in proximity/contact with the porous membranes the oxide material may form deposits and/or build-ups on the membrane surfaces and may otherwise foul the membrane. As such oxide fouling increases it can affect the performance/operation of the membrane and can inhibit the desired passage of lithium ions therethrough. If the build up of oxide continues, such as during prolonged stoppages, or due to relatively high carbonate influx, the oxide can displace the catholyte and impede metal flow to the collection point. This can make designs in which the membranes are submerged in generally static electrolyte baths problematic to operate in a commercially viable manner, even though the use of lithium carbonate or lithium hydroxides as the lithium chemical feedstock may be preferable to other feedstock materials.

Salt baths used in electrowinning cells that are exposed to the ambient atmosphere may absorb moisture from the atmosphere while the cell is in use, which may lead to additional fouling or degradation in membrane performance.

Despite the advances made to date in the development of molten salt electrolysis devices utilizing a porous membrane, there is significant room for improvement to address the above-mentioned problems and shortcomings of the prior art and there remains a need for an improved electrowinning cell configured for producing lithium from a lithium chemical feedstock material.

In accordance with one broad aspect of the teachings described herein, a flow-through electrowinning apparatus for electrowinning a metal from a metal chemical feedstock material, can include an anolyte chamber configured to receive an anolyte material and a metal chemical feedstock material and containing an anode. The anolyte chamber may provide an anolyte flow path extending between an anolyte inlet configured to receive a flow comprising the anolyte material from an anolyte reservoir via an anolyte supply conduit and an anolyte outlet through which a flow comprising feedstock-depleted anolyte material can exit the anolyte chamber. A catholyte chamber may have a cathode and may provide a catholyte flow path extending between a catholyte inlet configured to receive a flow of catholyte material from a catholyte reservoir via a catholyte supply conduit and a catholyte outlet through which an outlet material stream comprising the catholyte material and a metal product exits the catholyte chamber. A separator assembly may fluidly and electrically isolate the anolyte chamber and the catholyte chamber and may include a porous membrane configured to permit metal ion migration between the anolyte chamber and the catholyte chamber when an activation electric potential that is sufficient to initiate electrolysis of the metal chemical feedstock material within the anolyte chamber is applied between the anode and cathode. When the apparatus is in use and the activation electric potential is applied: i) the metal chemical feedstock material and the flow of anolyte material may enter the anolyte chamber and the flow of catholyte material may enter the catholyte chamber via the catholyte inlet; ii) metal cations separated from the metal chemical feedstock may migrate from the anolyte chamber to the catholyte chamber through the porous membrane, thereby depleting the amount of metal chemical feedstock material in the anolyte chamber and creating the metal product within the catholyte chamber; and iii) the flow of feedstock-depleted anolyte material exits the anolyte chamber via the anolyte outlet and the outlet material stream exits the catholyte chamber via the catholyte outlet.

The anolyte chamber may be at a first hydrostatic pressure and the catholyte chamber may be at a second hydrostatic pressure that is greater than the first pressure, whereby the flow or flux of either of the electrolyte materials through the membrane will be at least substantially, and preferably may be exclusively in one direction, from the catholyte chamber to the anolyte chamber through the porous membrane. This may help prevent unwanted materials, byproducts or contaminants that are present within the anolyte chamber from crossing the membrane into the catholyte chamber. This arrangement can also inhibit a counter flux of material (such as anolyte material, feedstock material, carbonates and other ions) in the opposite direction through the membrane from the anolyte chamber to the catholyte chamber The anolyte material may include a molten salt, and optionally may include a molten chloride salt.

The catholyte chamber may be bounded by a catholyte sidewall that extends axially between a first end and an opposing second end. The membrane may include an elongate membrane tube that extends axially from the first end of the catholyte sidewall into an interior of the catholyte chamber and wherein the anode extends axially within the elongate tube.

The cathode may include the sidewall of the catholyte chamber and may laterally surround the anode.

An anolyte sidewall may partially bound the anolyte chamber and may extend from a first end proximate the first end of the catholyte sidewall to an opposing second end. The separator assembly may be disposed between the first end of the catholyte sidewall and the first end of the anolyte sidewall and may be configured to separate the catholyte chamber from the anolyte chamber and electrically isolate the catholyte sidewall from the anolyte sidewall.

The anolyte sidewall and catholyte sidewall may be part of a common housing containing the catholyte chamber and the anolyte chamber.

The separator assembly may include a first seal assembly configured to fluidly seal the first end of the catholyte sidewall. The first seal assembly may include a body having a catholyte sealing surface that is exposed to the catholyte material.

The body may include an aperture receiving a first end of the elongate membrane tube and an anolyte sealing surface surrounding the aperture and exposed to the anolyte material.

The anolyte inlet may be disposed at a second end of the elongate membrane tube whereby anolyte material can enter the second end of the elongate membrane tube on one side of the body and exit the first end of the elongate membrane tube on the other side of the body.

At least a majority of the catholyte sealing surface may be covered by a layer of frozen catholyte material deposited on the catholyte sealing surface.

The layer of frozen catholyte material deposited on the catholyte sealing surface may have a steady state thickness when the apparatus is in use of between about 0.5 mm and about 25 mm.

The body may include a protective collar portion surrounding the aperture and extending axially to cover a portion of the elongate membrane tube disposed within the catholyte chamber to protect the portion of the elongate membrane tube disposed within the catholyte chamber from exposure to the catholyte materials and the metal product.

The aperture may be larger than the first end of the elongate membrane tube whereby a gap is formed between the body and the first end of the elongate membrane tube. Frozen catholyte material may be disposed within the gap to fluidly seal the gap when the apparatus is in use.

At least a majority of the anolyte sealing surface may be covered by a layer of frozen anolyte material deposited on the anolyte sealing surface.

The body may be maintained at a seal temperature that is lower than the freezing temperature of the catholyte material.

The seal temperature may be lower than the freezing temperature of the anolyte material.

An internal cooling conduit may extend through the body through which a coolant fluid can be circulated to maintain the body at the seal temperature.

The body may be formed from a metal comprising at least one of copper, aluminum, steel, stainless steel, cast iron, brass, bronze, nickel- or cobalt-based super-alloys, titanium or graphite.

An electrically non-conductive isolating gasket may be disposed between the body and the catholyte housing, whereby the body is electrically insulated from the catholyte housing.

The isolating gasket may include a catholyte facing portion proximate the body and wherein the catholyte facing portion is at least partially covered with the layer of frozen catholyte material when the apparatus is in use, thereby protecting the isolating gasket from exposure to the molten catholyte material within the catholyte chamber.

A second seal assembly may fluidly seal the second end of the catholyte sidewall. The elongate membrane tube may include a second end sealed by the second seal assembly and the second end of the elongate membrane tube may include the anolyte inlet.

The second seal assembly may include a body having an aperture and a catholyte sealing surface that is exposed to the catholyte material and is at least partially covered by a layer of frozen catholyte material.

The second end of the elongate membrane tube may be received within and may be smaller than the aperture of the second seal assembly, whereby a gap is formed between the second end of the elongate membrane tube and the aperture of the second seal assembly. Frozen catholyte material may be disposed within the gap to fluidly seal the gap.

The body of the second seal assembly may be maintained at a second seal temperature that is lower than the freezing temperature of the catholyte material.

An internal cooling conduit may extend through the body through which a coolant fluid can be circulated to maintain the body at the second seal temperature.

The body may be formed from a metal comprising at least one of copper, aluminum, steel, stainless steel, cast iron, brass, bronze, nickel- or cobalt-based super-alloys, titanium or graphite.

The anolyte chamber and catholyte chamber may be maintained at an operating temperature that is greater than a freezing temperature of the anolyte material and the catholyte material.

The operating temperature may be greater than about 353 degrees C.

The anolyte material may be heated to the operating temperature by an anolyte heater that is external the anode chamber prior to entering the anolyte inlet.

The catholyte material ay be heated to the operating temperature by a catholyte heater that is external to the catholyte chamber prior to entering the catholyte inlet.

The metal may be lithium, the metal chemical feedstock may be a lithium chemical feedstock.

The lithium chemical feedstock may include at least one of lithium carbonate and lithium hydroxide.

The metal product may include lithium metal.

The catholyte material in the catholyte chamber may include a carrier metal that reacts with lithium to form a product alloy in situ within the catholyte chamber.

The metal product may include the product alloy.

The catholyte material entering the catholyte inlet may include the carrier metal.

The catholyte material in the catholyte reservoir may include the carrier metal.

An anolyte return flow path may extend between the anolyte outlet and the anolyte reservoir, via which at least a portion of the feedstock-depleted anolyte is returned to the anolyte reservoir.

A separator may be located outside the catholyte chamber and downstream from the catholyte outlet. The separator may be configured to receive the outlet material stream and separate the catholyte material from the metal product.

A catholyte recycle flow path may extend from the separator to the catholyte reservoir via which the catholyte material separated by the separator is returned to the catholyte reservoir.

A head space may be disposed in an upper portion of the anolyte chamber and a vent conduit may be in fluid communication with the head space. When the apparatus is in use anode gases produced in the anolyte chamber may collect in the head space and can be withdrawn from the anolyte chamber via the vent conduit.

The operating temperature may be preferably at least greater than the melting points of the catholyte, anolyte and feedstock material electrolyte. In some examples the operating temperature can be above 180, 200, 220, 240, 250, 270, 280, 300, 320, 340, 350, 360, 380, 400, 420, 440, 460, 480, 500, 600 degrees Celsius or more and may be less than about 700, 650, 600, 550, 500, 480, 460, 440, 420 degrees Celsius in some preferred examples.

A heater may be used to keep the anolyte chamber and the catholyte chamber at the operating temperature.

The catholyte chamber and the anolyte chamber may be contained in a housing and the heater may include a heating element in contact with an outer surface of the housing.

The catholyte chamber and the anolyte chamber may be contained in a housing and the heater includes a furnace chamber having an interior that is maintained at or above the operating temperature, and wherein the housing is disposed within the interior of the furnace chamber.

A catholyte reservoir may be external the housing and may be disposed within the furnace chamber. The electrolyte material contained within the catholyte reservoir may be maintained at or above the operating temperature.

An anolyte reservoir may be external the housing and may be disposed within the furnace chamber. Anolyte material contained within the anolyte reservoir may be maintained at or above the operating temperature.

The catholyte material may include at least one of chloride, fluoride, iodide, bromide, sulphate, nitrate and carbonate salts, and mixtures thereof.

The catholyte material may include at least one of LiCl—KCl, LII-KI and LiI—CsI.

The catholyte material may include a mixture of LiCl—KCl, LII-KI and LiI—CsI.

The catholyte material may be a eutectic mixture of LiCl—KCl, LII-KI and LiI—CsI, in which the concentrations are 46% LiCl-54% KCl (by weight), 58.5% LII-41.5% KI (by weight) and 45.7% LiI-54.3% CsI (by weight).

The porous membrane comprises at least one of Beryllia, Yttrium aluminate, thoria, magnesium aluminate spinel, aluminum nitride, yttria, boron nitride, alpha lithium aluminate, magnesia, lithium magnesite, lithium aluminum spinel, boria, mullite, zirconia, and magnesium oxide.

In accordance with another broad aspect of the teachings described herein, a process for electrowinning a metal from a metal chemical feedstock material using a flow-through electrowinning apparatus can include the steps of:

a) conveying a molten, anolyte material and a metal chemical feedstock material along an anolyte flow path within an anolyte chamber containing an anode;

b) conveying a molten, catholyte material along a catholyte flow path within a catholyte chamber that has a cathode and is separated from the anolyte chamber via a separator assembly that includes a porous membrane configured to permit metal ion migration between the anolyte chamber and the catholyte chamber;

c) applying an activation electric potential between the anode and the cathode that is sufficient to electrolyze and separate metal cations from the metal chemical feedstock material in the anolyte chamber, thereby causing a flux of metal cations to migrate through the porous membrane from the anolyte chamber to the catholyte chamber and a metal product to be formed in the catholyte chamber;

d) while applying the activation electric potential, extracting a feedstock-depleted anolyte material from the anolyte chamber via an anolyte outlet; and e) while applying the activation electric potential, extracting an outlet material comprising the catholyte material and the metal product from the catholyte chamber via a catholyte outlet.

Step a) may include conveying the metal chemical feedstock material and the anolyte material into the anolyte chamber via an anolyte inlet.

The process may include providing an anolyte reservoir outside the anolyte chamber and wherein step a) may include conveying the anolyte material from the anolyte reservoir to the anolyte chamber via an anolyte supply conduit.

The process may include adding the metal chemical feedstock material to anolyte material contained in the anolyte reservoir to provide the feedstock-rich anolyte stream, and step a) may include conveying both the anolyte material and the metal chemical feedstock material from the anolyte reservoir to the anolyte chamber via the anolyte supply conduit.

The process may include recycling at least a portion of the feedstock-depleted anolyte material extracted from the anolyte chamber back into the anolyte reservoir.

The process may include maintaining the anolyte material and the metal chemical feedstock at an operating temperature above the freezing temperature of the anolyte material.

The process may include heating the anolyte material and the metal chemical feedstock to the operating temperature before it enters the anolyte chamber.

The process may include providing a catholyte reservoir outside the catholyte chamber and wherein step b) may include conveying the catholyte material from the catholyte reservoir to the catholyte chamber via a catholyte supply conduit.

The process maintaining the catholyte material at an operating temperature above the freezing temperature of the catholyte material.

The process may include heating the catholyte material to the operating temperature before it enters the catholyte chamber.

The metal product may consist of the metal.

The process may include processing the outlet material using a separator located outside the catholyte chamber to separate the metal from a residual catholyte material.

The process may include recycling at least a portion of the residual catholyte material back into the catholyte reservoir.

The catholyte material in the catholyte chamber may include a carrier metal that reacts with metal in the catholyte chamber to form a metal product alloy in situ within the catholyte chamber.

The metal product may include the metal product alloy.

The catholyte material entering the catholyte chamber may already include the carrier metal.

A catholyte reservoir may be provided outside the catholyte chamber containing catholyte material, and the method may include mixing the carrier metal with the catholyte material in the catholyte reservoir before the catholyte material is conveyed to the catholyte chamber.

The process may include processing the outlet material using a separator located outside the catholyte chamber to separate the metal product alloy from a residual catholyte material.

The process may include recycling at least a portion of the residual catholyte material into the catholyte reservoir.

The process may include pressurizing the anolyte chamber to a first hydrostatic pressure and the catholyte chamber to a second hydrostatic pressure that is greater than the first pressure, whereby a flow or flux of either of the electrolyte materials through the membrane will be at least substantially, and preferably may be exclusively in one direction, from the catholyte chamber to the anolyte chamber through the porous membrane. This may help prevent unwanted materials, byproducts or contaminants that are present within the anolyte chamber from crossing the membrane into the catholyte chamber.

A pressure difference between the first hydrostatic pressure and the second pressure may be between about 1 and about 18 inches of water gauge, and optionally is between about 1 and about 3 inches of water.

The separator assembly further may include a first seal assembly fluidly sealing one end of the catholyte chamber and having a body and a catholyte sealing surface that is exposed to the catholyte material. The process may include maintaining the body and the catholyte sealing surface at a seal temperature that is lower than a freezing temperature of the catholyte material, whereby a layer of frozen catholyte material is deposited on the catholyte sealing surface and electrically isolates the body from the catholyte material.

The body may include an anolyte sealing surface that is exposed to the anolyte material, whereby a layer of frozen anolyte material is deposited on the anolyte sealing surface and electrically isolates the body from the anolyte material.

The porous membrane may include an elongate membrane tube extending through an interior of the catholyte chamber and forming part of the anolyte flow path. The anolyte material and a metal chemical feedstock may flow axially through the elongate membrane tube.

Steps a)-e) may occur concurrently.

The metal may be lithium and the metal chemical feedstock may be a lithium chemical feedstock.

The lithium chemical feedstock may include at least one of lithium carbonate and lithium hydroxide.

BRIEF DESCRIPTION OF THE DRAWINGS

Embodiments of the present disclosure will be described with reference to the accompanying drawings, wherein like reference numerals denote like parts, and in which.

DETAILED DESCRIPTION

Figure 1:
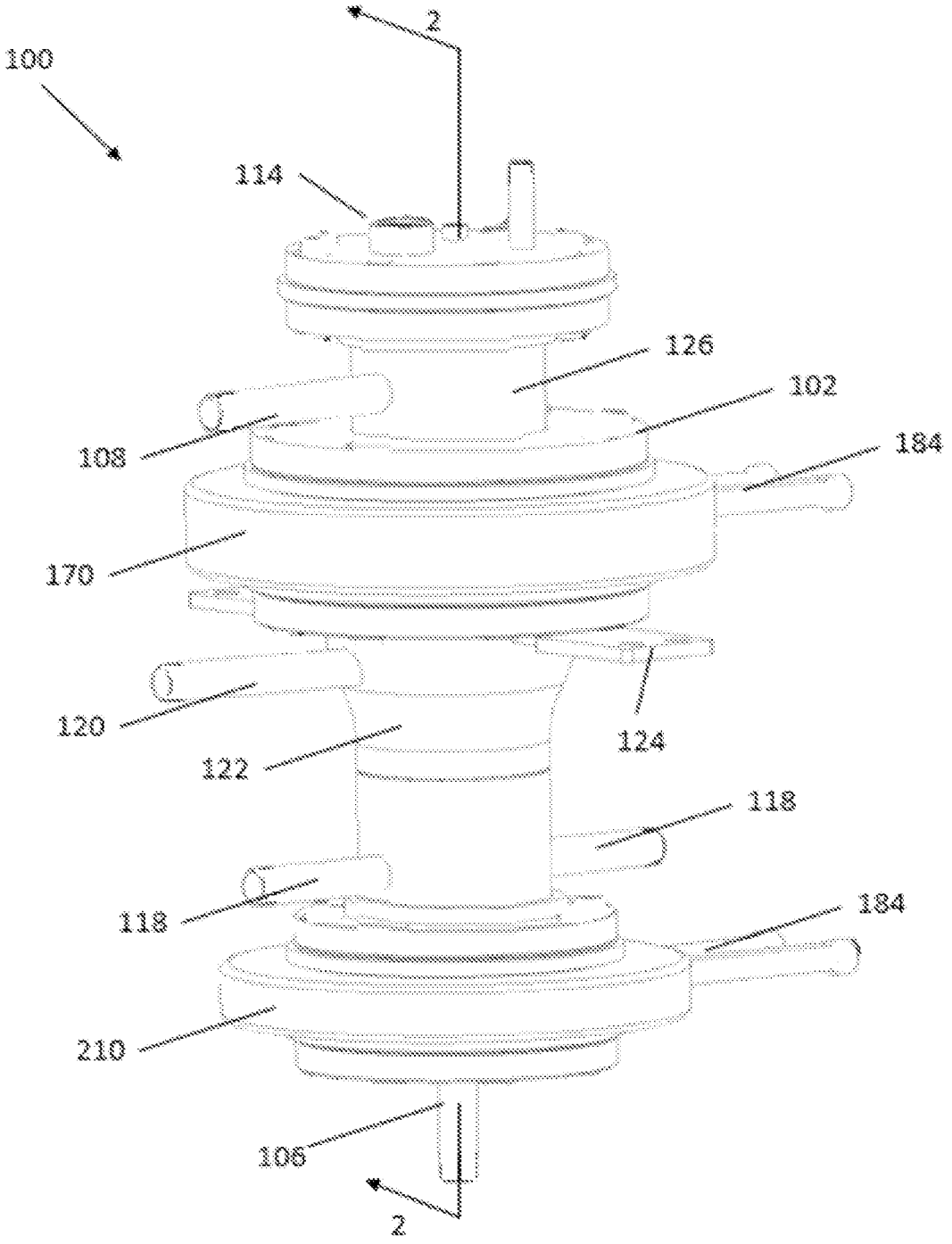
FIG. 1 is a perspective view of one example of a flow-through electrowinning cell.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

One broad aspect of the teachings described herein relates to a new electrowinning apparatus that can be used to produce a target metal product from a corresponding target metal feedstock material (such as a feedstock that includes a salt form of the target metal). The apparatus can be configured so that the target metal product is a crude form of the target metal. Alternatively, the apparatus can be configured to include other suitable compositions, such as one or more base or carrier metals that is provided within the apparatus, so that when the target metal ions are separated from the feedstock material they can react with the carrier metal (optionally in situ within the refining cell or optionally in another location) to form a target metal alloy—that is a combination of at least the target metal and one of the carrier metals. In these examples, the metal product can be the target metal alloy, which may be less reactive than the target metal itself or may have other properties that are desirable. Some suitable examples of target metals that could be produced using the apparatuses and techniques described herein include lithium, sodium, tin, copper, magnesium and nickel and the like.

For example, the target metal may be lithium and the feedstock materials may be a lithium chemical feedstock. The lithium chemical feedstock material may be any suitable material, and preferably may include lithium carbonate, lithium hydroxide or the like. While the examples herein are described with reference to producing lithium as the target metal, the apparatuses and processes herein may also be applied to the production of other suitable metals from other suitable feedstock material.

Preferably, the apparatus is configured so that it has a generally sealed interior that is fluidly isolated from the surrounding environment so that moisture and oxygen from the atmosphere are inhibited from entering the interior.

Within the interior, the cell can include an anolyte compartment that is configured to receive a suitable anode and to contain, and preferably define at least a portion of an anolyte flow path that can allow a flow of the anolyte material to move through the anolyte chamber while the apparatus is in use. The anolyte preferably comprises a molten salt, such as a molten chloride salt that has been impregnated with a desired lithium chemical feedstock material (such as, for example lithium carbonate $Li_2CO_3$). In examples where the cell is configured as a flow-through cell, an anolyte reservoir may be provided outside the cell and may be fluidly connected using any suitable anolyte supply and return conduits. The anolyte reservoir may include any suitable tank or other such vessel, along with any desired flow control, agitation, stirring, mixing, heating, and/or pumping equipment that can circulate the anolyte as desired. The anolyte reservoir may also include one or more inlets for receiving the lithium chemical feedstock and/or top up chloride salt (or other suitable material). The apparatus is also configured to allow the feedstock material, such as the lithium chemical feedstock to be introduced into the anolyte chamber as needed. This may be done by providing a feedstock inlet and introducing the feedstock material directly into the interior of the anolyte chamber, where it can then mix with the anolyte material. Alternatively, the feedstock material can be mixed with the anolyte material before it enters the anolyte chamber, and the blended material stream that is relatively rich in feedstock material can enter via the anolyte inlet. This pre-mixing of the feedstock material and the anolyte material may be done in any suitable vessel or location. For example, the feedstock material may be introduced into the external anolyte reservoir, rather than directly into the anolyte chamber of the cell, may help more evenly mix the lithium chemical feedstock into the anolyte material (for example as it can be assisted by mechanical agitation) before the mixture flows into and through the anolyte chamber.

Circulation of the anolyte material may also allow relatively improved heat management and temperature control of the anolyte material while the cell is in use, as the anolyte flow path outside the anolyte chamber may include any suitable heat exchanger and/or heat exchanger that can be used to heat or cool the anolyte material. Such circulation may also help facilitate the use of relatively higher current densities (than could be used in a similar cell with static electrolytes) because the flowing anolyte material can continuously replenish the feedstock material (e.g. lithium carbonate) that is proximate the anode, as feedstock-depleted anolyte flows past the anode and is replaced by incoming, relatively feedstock-rich anolyte material.

Preferably, the cell also includes a catholyte chamber that contains, or is at least partially bounded, by a suitable cathode (e.g. the catholyte housing/sidewall may form some or all of cathode) and is configured to contain, and preferably allow the circulation of a suitable catholyte material. Preferably, the catholyte chamber is at least partially fluidly separated from the anolyte compartment by a suitable separator assembly that can provide a suitable amount of separation and electrical isolation between the anolyte and catholyte chambers. This separation can help limit mixing of the anolyte and catholyte materials (whether static or flowing), but is understood to still permit the passage of ions and some relatively small amount of material between the anolyte and catholyte chambers during the electrowinning process. Preferably, the separator assembly is at least partially formed from a suitable porous membrane, such as a porous ceramic membrane that can allow a migration of the target metal ions (such as lithium cations) from the anolyte compartment to the catholyte compartment while the apparatus is in use. For example, the separator assembly can be provided in any suitable structure, and may be formed from any suitable material, that can help generally separate the catholyte from the anolyte while still allowing a desired level of ion transfer, and possible material flux between the anolyte chamber and catholyte chamber while the cell is in use to achieve the desired reactions and metal formation. Preferably, at least a portion of the separator assembly may be provided by a suitable membrane material, such as a substantially rigid and porous ceramic membrane that can maintain separation between the anolyte and catholyte while allowing a desired degree of ion transfer. Some examples of suitable membrane materials include Beryllia, Yttrium aluminate, thoria, magnesium aluminate spinel, aluminum nitride, yttria, boron nitride, alpha lithium aluminate, magnesia, lithium magnesite, lithium aluminum spinel, boria, mullite, zirconia, magnesium oxide and similar materials.

The catholyte material may be a molten salt, and in examples where the cell is configured as a flow-through cell, a catholyte reservoir may be provided outside the cell and may be fluidly connected using any suitable catholyte supply and return conduits. The catholyte reservoir may include any suitable tank or other such vessel, along with any desired flow control and/or pumping equipment that can circulate the catholyte as desired. It may also include heaters, mixers and other such equipment. Providing an external catholyte reservoir of this nature may allow for the electrowinning system to utilize a larger total volume of catholyte material while it is in use than can be contained within the catholyte chamber at any given time. This can help increase the total by-product/contamination load (for example, quantities of lithium oxides when using a lithium carbonate feedstock) that can be absorbed in the catholyte material and tolerated by the apparatus/cell before the performance of the cell is materially impacted. This may help increase run time of the cell. Additionally, catholyte purification measures can be introduced into the catholyte reservoir, or else where along the catholyte supply or return conduit to remove undesirable impurities.

Optionally, for example if the cell is configured to produce a metal product that is an alloy instead of the merely a crude metal product, the catholyte circulation system may be configured to receive an alloying/carrier metal, such as by having a carrier metal inlet somewhere along the system (optionally in the catholyte chamber, the catholyte reservoir, along the supply or return conduits or in a separate mixing vessel). This can allow a carrier metal to be carried with the catholyte material and for a desired output alloy to be formed in situ within the catholyte chamber during the electrowinning process. This may be desirable when electrowinning relatively reactive metals, such as lithium, as a lithium-containing alloy may be more stable and/or easier to handle, store, transport or otherwise process than the bare crude target metal (e.g. crude lithium metal). Some examples of suitable carrier metals can include lead, bismuth, zinc, mercury, tin, aluminum, magnesium, indium, thallium, and the like and alloys or mixtures of two or more such metals. Preferably, the carrier metal may include a combination of bismuth, tin and indium.

Preferably, the apparatus can be operated in a manner that may help reduce the presence and/or accumulation of oxides, non-metal ions or other such impurities within the catholyte chamber, as this may help reduce fouling of the membrane. In one example, the cell can be operated so that a hydrostatic pressure within the catholyte chamber is at least equal to, and preferably is at least somewhat greater than the hydrostatic pressure within the anolyte compartment, thereby creating a pressure differential at the membrane. This pressure difference can be achieved using any suitable combination of pumps and flow control apparatuses.

Having conducted tests under these pressure conditions, the applicant has determined that there is a material flux substantially exclusively from the catholyte chamber to the anolyte chamber when the catholyte chamber is at a higher hydrostatic pressure than anolyte chamber. It is believed that these pressure-based effects may be effective because the hydrostatic pressure gradient may be sufficient to overcome the relatively weaker osmotic forces due to concentration gradients or local flow pressure differences that may tend to urge the non-metal ions or other impurities from the anolyte chamber toward the catholyte chamber.

In some circumstances this pressure difference could permit a net outward flux of catholyte material from the catholyte compartment and can help flush oxides and other contaminants out of the membrane and into the circulating anolyte material, which can then carry the contaminants away from the membrane. This may also help inhibit the flow of the lithium chemical feedstock, such as lithium carbonate, into the catholyte compartment, thereby reducing back-reaction with the metal and eliminating an important source of oxide formation while increasing current efficiency. The difference in pressures is preferably sufficient to provide the desired flow effects, but not so high as to put significant stress on the membrane material or otherwise materially impact the mass balance or operation of the cell. For example, a pressure difference across the membrane may be between about 1 and about 18 inches of water gauge in some examples.

To help maintain desirable levels of catholyte and anolyte materials within the cell, the flow rates of the catholyte and anolyte materials can be balanced to account for the catholyte flux through the membrane, and/or make-up material can be added to either stream so that the levels and pressures of the catholyte and anolyte materials remain in the desired ranges.

In some examples, a membrane that has desirable mechanical and ion transfer properties may be prone to damage if it is in fluid communication with/contacted by the molten metal that is formed within the catholyte chamber and it may be desirable to reduce the amount of direct contact between the metal and the membrane, for example by providing a protective layer that can separate the membrane from the molten metal with the catholyte chamber. The protective layer may be formed from frozen electrolyte material and optionally may also help seal the catholyte chamber and may be part of a suitable sealing assembly, as well as sealing against the membrane, to help provide the fluid isolation between the catholyte chamber and the anolyte chamber.

One example of a suitable seal assembly can be referred to as a freeze seal that includes a body portion that is cooled to a seal temperature that is lower than the freezing temperature of the catholyte and/or anolyte materials it is in contact with so that a skin/layer of solidified, frozen catholyte material (e.g. a layer of frozen, solidified salt) forms on the outer, sealing surface(s) of the body. This frozen salt layer can also help fill spaces/gaps between the body and the membrane and may also help protect the body from ongoing exposure to the molten salt catholyte. Such a sealing assembly may also be considered as generally self-healing seal, as portions of the frozen salt layer that become damaged or break away from the body can be replaced by newly frozen salt material when the molten salt comes into contact with the cooled body.

A similar self-healing, freeze seal assembly can be provided at other locations in the cell and may be used to seal against other portions of the membrane or other operating components. For example, a self-healing, freeze seal can be provided to help seal the location where the membrane extends through the outer walls/perimeter of the cell.

The applicant has also determined that facilitating a flow of catholyte material through the catholyte chamber while the apparatus is in use may also help reduce the chances of membrane damage. This may be because the flow and generally ongoing withdrawal of the product stream from the catholyte chamber tends keep at least some of the lithium metal mixed/entrained within the catholyte material such that is less likely to remain stagnant at the top of the chamber and collect in regions adjacent the membrane. The ongoing withdrawal of the product stream may also reduce the residence time of the metal product (e.g. lithium metal) as it is withdrawn from the catholyte chamber along with portions of the catholyte material.

Introducing the suitable carrier metal into the catholyte chamber may also help reduce the chances of the lithium metal (or other target metal) damaging the membrane as the lithium may be almost immediately alloyed with the carrier metal in situ within the catholyte chamber to provide a relatively less reactive lithium alloy that is less damaging to the membrane.

It may also be preferable in some examples of the cells described herein to at least substantially electrically isolate the cathode from the anode. In such examples, the self-healing, freeze seals may also be configured to be electrically insulating. This may be done by forming the cooled body portion from an electrically insulating material and/or by including one or more other suitable insulating gaskets, layers, seals and the like. Some examples of suitable insulating materials can include Teflon®, mica, vermiculite, rubber and the like. To help protect these insulating materials from the molten salt within the cell they may also be at least partially coated with a layer of frozen salt as part of the freeze seal assembly, or cooled by the cooling influence of the freeze seal.

Optionally, one or more of the cells described herein can be arranged together to form larger electrowinning systems with increased production capacity. In some arrangements, two or more cells may be connected in parallel with common anolyte and catholyte reservoirs.

Preferably, as described herein a flow-through electrowinning apparatus for electrowinning a target metal from a target metal chemical feedstock material can include an anolyte chamber that is configured to receive both an anolyte material and a metal chemical feedstock material (optionally separately in individual materials streams or combined in a common incoming feedstock-rich anolyte material stream) and can contain a suitable an anode. The anolyte chamber preferably defines at least part of an anolyte flow path extending between an anolyte inlet configured to receive a flow including the anolyte material from an anolyte reservoir via an anolyte supply conduit and, and an anolyte outlet through which a flow comprising feedstock-depleted anolyte material can exit the anolyte chamber. A corresponding catholyte chamber in the apparatus can have a cathode and can provide at least part of a catholyte flow path extending between a catholyte inlet configured to receive a flow of catholyte material from a catholyte reservoir via a catholyte supply conduit and a catholyte outlet through which an outlet material stream comprising the catholyte material and a metal product exits the catholyte chamber. A suitable separator assembly is used to fluidly and electrically isolate the anolyte chamber and the catholyte chamber from each other and includes a porous membrane that is configured to permit metal ion migration between the anolyte chamber and the catholyte chamber when an activation electric potential that is sufficient to initiate electrolysis of the metal chemical feedstock material within the anolyte chamber is applied between the anode and cathode.

When the apparatuses of this nature are in use and the activation electric potential is applied the metal chemical feedstock material and the flow of anolyte material can enter the anolyte chamber and the flow of catholyte material enters the catholyte chamber via the catholyte inlet. Under these conditions metal ions that are separated from the metal chemical feedstock will tend to migrate from the anolyte chamber to the catholyte chamber through the porous membrane. This will deplete the amount of metal chemical feedstock material in the anolyte chamber and will lead to the creation of the metal product (either the metal or an alloy containing the metal if a carrier metal is also provided) within the catholyte chamber. As the reactions continue, the flow of feedstock-depleted anolyte material can exit the anolyte chamber via the anolyte outlet and the outlet material stream exits the catholyte chamber via the catholyte outlet. Both exiting material streams may be sent for further processing (such as to separate the metal product from the catholyte material in the output stream), and optionally may be at least partially recycled in the anolyte and catholyte chambers.

Processes for using the apparatus described herein to produce the desired metal products can include using a flow-through electrowinning apparatus, which includes the steps of a) conveying a molten, anolyte material and a lithium chemical feedstock material along an anolyte flow path within an anolyte chamber containing an anode, b) conveying a molten, catholyte material along a catholyte flow path within a catholyte chamber that has a cathode and is separated from the anolyte chamber via a separator assembly that includes a porous membrane configured to permit lithium ion migration between the anolyte chamber and the catholyte chamber; c) applying an activation electric potential between the anode and the cathode that is sufficient to electrolyze and separate lithium cations from the lithium chemical feedstock material in the anolyte chamber, thereby causing a flux of lithium cations to migrate through the porous membrane from the anolyte chamber to the catholyte chamber and a lithium product to be formed in the catholyte chamber; d) while applying the activation electric potential, extracting a feedstock-depleted anolyte material from the anolyte chamber via an anolyte outlet; and e) while applying the activation electric potential, extracting an outlet material stream that includes the catholyte material and the lithium product from the catholyte chamber via a catholyte outlet.

Figure 2A:
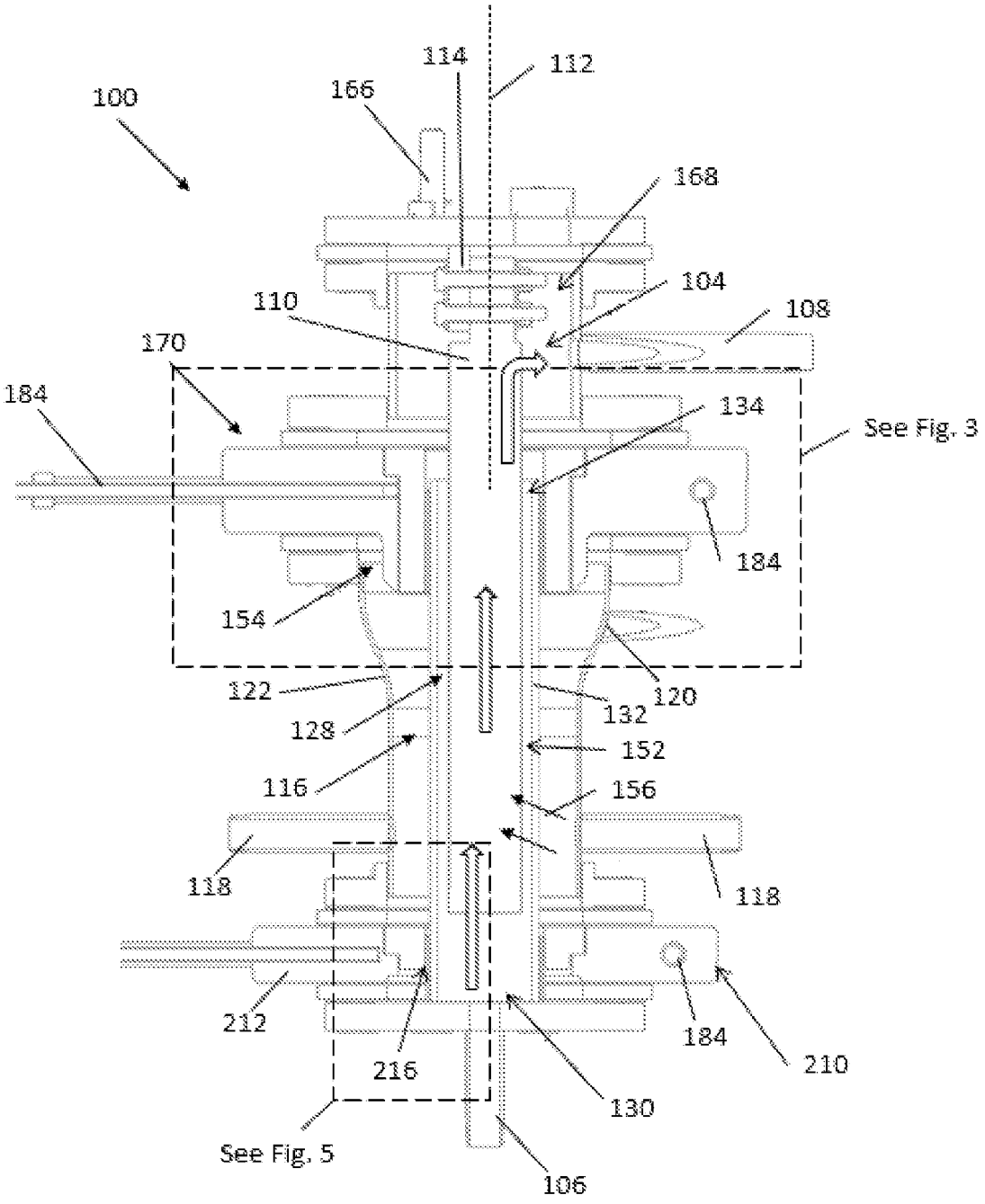
FIG. 2*a* is a side cross-sectional view of the electrowinning cell of FIG. 1, taken along line 2-2.
Figure 2B:
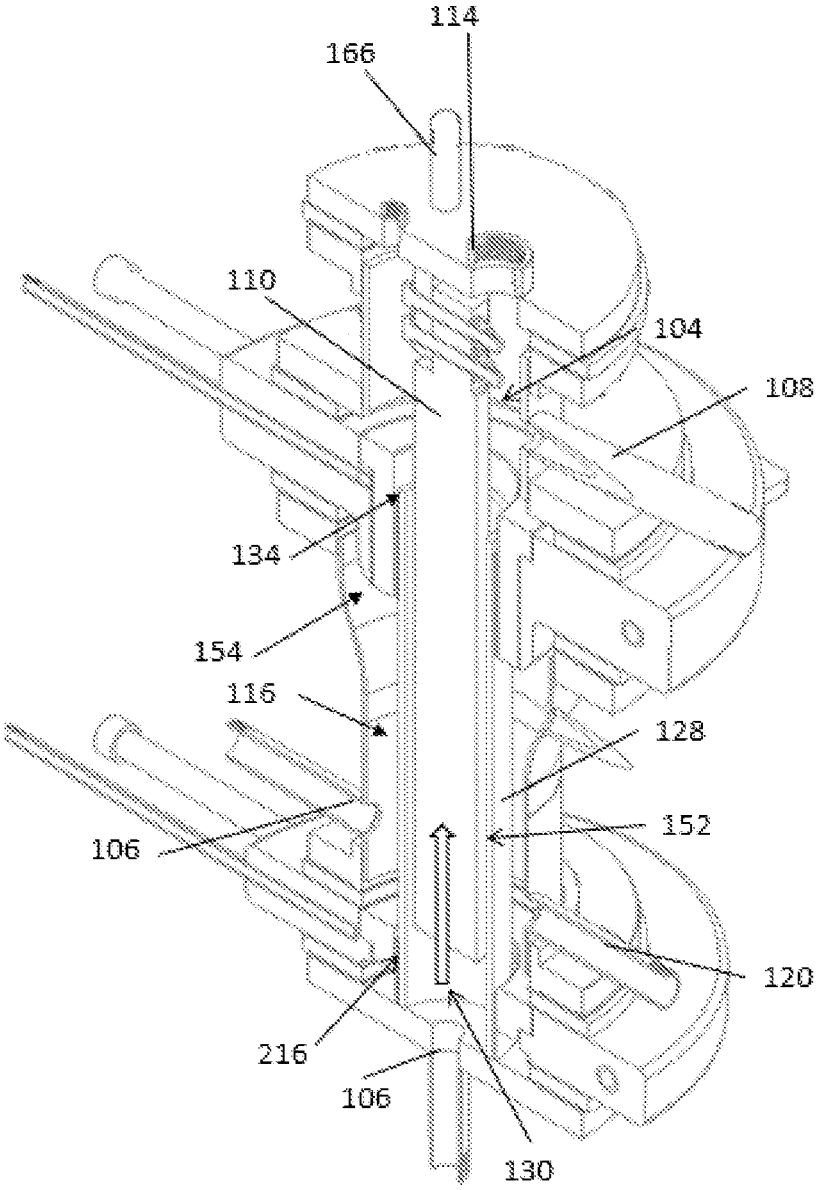
FIG. 2*b* is a perspective cross-sectional view of the electrowinning cell of FIG. 1, taken along line 2-2.

Referring to FIGS. 1-2*b*, a schematic representation of one example of an electrowinning apparatus that is configured as a flow-through cell 100 and to produce lithium metal from a lithium chemical feedstock is illustrated. An analogous apparatus could be used to produce other target metal products from a suitable target metal feedstock as noted herein.

In this example the cell 100 includes a housing 102 defining a cell interior that includes an anolyte chamber 104 that is fluidly connected between an anolyte inlet 106 and an anolyte outlet 108. The anolyte chamber 104 has an upper portion that is above a catholyte chamber 116 bounded by a portion of the housing 102 (e.g. by an anolyte chamber sidewall) and a lower portion that is bounded by a membrane (as described herein) and that is laterally surrounded by the catholyte chamber and catholyte material when in use.

An anode, which in this example is an elongate, rod-like anode 110 extends axially within the anolyte chamber 104 in a direction that is generally aligned with the cell axis 112. An anode connection 114 is electrically connected to the anode 110 and is connectable to a suitable power source.

The interior of the housing 102 also includes a catholyte chamber 116 that is in fluid communication with an associated catholyte inlet 118 and catholyte outlet 120. In this example, the catholyte chamber 116 is at least partially bounded by a catholyte sidewall that is provided by an electrically conductive portion of the housing 102, which also functions as the cathode 122 in this arrangement. In this arrangement, the cathode 122 laterally surrounds the catholyte material, the membrane and the anode 110, and provides a relatively large electrode surface area, as compared to a separate cathode member that could be positioned within a cathode chamber with a non-conductive sidewall. This cathode 122 is connectable to the suitable power source via a cathode connection 124. As described in more detail herein, the catholyte sidewall section of the housing 102 that functions as the cathode 122 in this example is electrically isolated from an upper portion 126 of the housing 102 that can be described as an anolyte sidewall that at least partially bounds the anolyte chamber 104. This anolyte sidewall extends from a first end that is proximate the first or upper end of the catholyte sidewall (e.g. the wall forming the cathode 122) to an opposing second or upper end. In this example, the separator assembly is located between the upper end of the catholyte sidewall (and cathode 122) and the lower end of the anolyte sidewall 126 and is configured to separate the catholyte chamber 116 from the anolyte chamber 104 and electrically isolate the catholyte sidewall (and cathode 122) from the anolyte sidewall 126.

To help separate the interiors of the anolyte chamber 104 and the catholyte chamber 116 the cell includes an elongate, axially extending tube-like membrane 128. In this example, the membrane 128 is configured as a generally hollow, elongate tube-like membrane or membrane tube having a lower end 130 that is located toward a lower end of the housing 102 and is in fluid communication with the anolyte inlet 106, an axially extending sidewall 132 that surrounds the anode 110 and passes through the catholyte chamber 116, and an opposing upper end 134 that is outside the catholyte chamber 116 and in fluid communication with an upper portion of the anolyte chamber 104 (bounded by the sidewall 126 and being located generally above the catholyte chamber 116 in this example). While the membrane 128 is illustrated as generally cylindrical in this example, other examples of the apparatuses described herein may have elongate membranes that have a non-cylindrical shape. In this arrangement, the interior of the membrane 128 forms a lower part/portion of the anolyte chamber 104 and anolyte flow path through the cell 100, which can help maintain a desired level of fluidic separation between the anolyte material flowing through the interior of the membrane 128 and the catholyte material surrounding the outer surface of the membrane 128.

Figure 6:
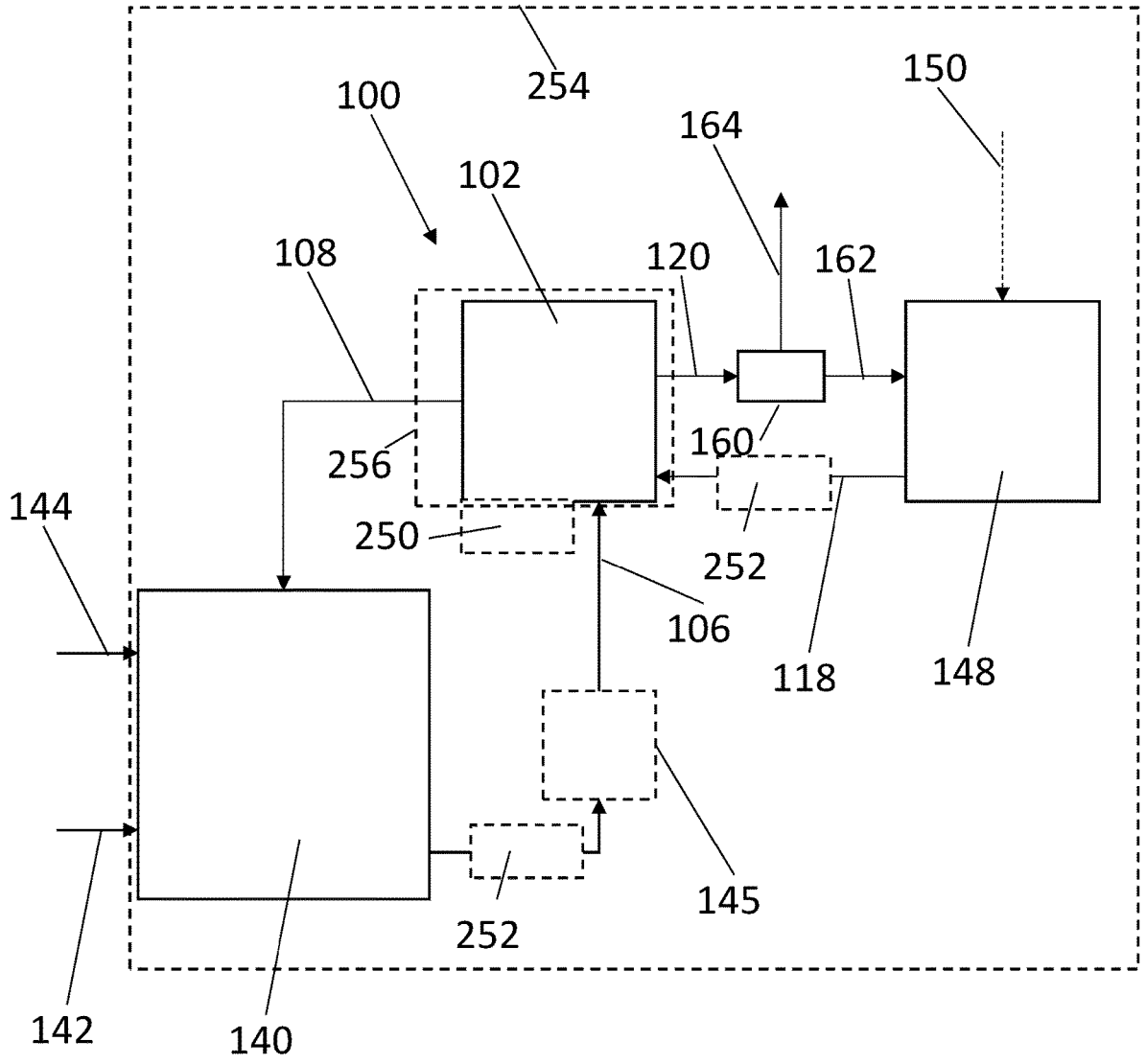
FIG. 6 is a schematic representation of a lithium production system including the electrowinning cell of FIG. 1.

Referring also to FIG. 6, when the cell 100 is in use, the molten anolyte material, containing a relatively high concentration of the lithium chemical feedstock ($Li_2CO_3$ in this example) is drawn from a suitable anolyte material reservoir 140 and fed into the anolyte inlet 106. The anolyte reservoir 140 can have an anolyte inlet port 142 for receiving make-up anolyte material and a feedstock port 144 for receiving the lithium chemical feedstock. While shown schematically as separate ports, the ports 142 and 144 may be combined as a single port. The anolyte reservoir 140 may also include other suitable equipment, such as heaters, stirrers or agitators, pumps, flow control apparatuses and the like which have not been illustrated schematically. The anolyte flow path may include a heater or any such apparatus that can keep the anolyte material above its freezing temperature, and in its desire molten state, along the anolyte flow path while the cell 100 is in use. This can include heating the anolyte reservoir 140, the supply and removal conduits, the anolyte chamber 104 and other portions of the apparatus that accommodate a flow of anolyte material while the system is in use. The anolyte flow path may optionally also include a heat exchanger 145 or other equipment for heating, cooling and/or otherwise conditioning the anolyte material.

Optionally, to help maintain the feedstock and the electrolyte (e.g. catholyte and anolyte) materials at the desired operating temperature, the apparatuses described herein can include any suitable type of heater that can be used to help keep the interior chamber at an operating temperature that is higher than the a freezing temperature of the feedstock material, the molten salt electrolyte material and the lithium metal or other metal product.

Optionally, a suitable heater can include a heating element in contact with an outer surface of the housing, such as an optional contact heating element 250 that is schematically illustrated in FIG. 6. Alternatively, or in addition to a housing heater like 250, the system could include one or more inline heaters having heating elements that can heat the flows of the feedstock and electrolyte materials while they are outside of the interior chamber of the cell—such as the heaters 252 illustrated schematically in FIG. 6. Each of these heating elements, can include resistive heaters, heat exchanger coils and any other suitable heating mechanism. Heaters 250 and 252 could be used together in some systems, or as alternatives in other systems (i.e. a system need not include both heaters 250 and 252).

Alternatively, or in addition to the heaters 250 or 252, the heater used with the apparatus can be an external heating device that does not need to be in direct contact with the housing 102 or the flowing materials. One example of such a device is a furnace chamber or other environment that is sized to contain the entirety of the cell, and optionally the feedstock and/or electrolyte material reservoirs (such as anolyte reservoir 140 or catholyte reservoir 148) and at least portions of the supply and recycle conduits. The interior of the furnace chamber can be heated to a temperature that is equal to, or preferably is slightly greater than the desired operating temperature of the cell. This ambient, environmental heating can heat the cell and its contents without exposing the heating elements to direct contact with the electrolyte or lithium metal, which may help reduce damage to the heating elements. Examples of such surrounding, furnace chambers are shown schematically as chambers 254 that is large enough to contain the housing 102, reservoir 140 and reservoir 148, and alternative chamber 256 that is large enough to contain the housing 102, but not the reservoirs 140 and 148. The heaters and chamber 250, 252, 254 and 256 are shown in dashed lines to indicate they are optional features of these examples. Any of the cells 100, 1100 and 2100 can use any of the contact heaters or external heating chambers described herein.

As the anolyte material flows along its anolyte flow path through the cell 100 (including at least a portion of the anolyte flow path that is provided by the interior of the anolyte chamber 104 including the interior of the membrane 128 as well as the anolyte inlet 106 and outlet 108), catholyte material is drawn from a suitable catholyte reservoir 148 and fed into the catholyte chamber 116 via the catholyte inlet 118. Optionally, as described herein, some examples of the apparatuses can be configured such that a carrier metal can also be provided within the catholyte chamber 116 while the apparatus is in use. Preferably, a carrier metal material be introduced into the catholyte flow path and can be mixed with the catholyte material before the material enters the catholyte chamber 116 (but alternatively may be introduced into the catholyte chamber without pre-mixing), for example if the cell 100 is to be configured to alloy the crude lithium metal with a carrier metal in situ within the catholyte chamber 116.

For example, the catholyte reservoir 148, or a suitable, separate combining apparatus separate from the catholyte reservoir, may include a carrier metal inlet port through which a suitable carrier metal can be fed into the catholyte material. The catholyte flow path may include a heater, heat exchanger or any such apparatus that can keep the catholyte material above its freezing temperature, and in its desire molten state, along the catholyte flow path while the cell 100 is in use. This can include heating the catholyte reservoir 148, the supply and removal conduits, the catholyte chamber 116 and other portions of the apparatus that accommodate a flow of catholyte material while the system is in use. The catholyte flow path may also include other suitable equipment, such as heaters, stirrers or agitators, pumps, flow control apparatuses and the like which have not been illustrated schematically.

In this example, a substantially annular portion of the anolyte chamber 104 that is disposed radially between the anode 110 and the cathode 122 can define an electrolysis region 152. In other configurations the electrolysis region may have a different shape.

When an activation electric potential that is sufficient to initiate electrolysis of the lithium carbonate feedstock material is applied between the anode 110 and cathode 122 the lithium carbonate feedstock material flowing generally axially through the electrolysis region 152 can be electrolyzed such that lithium cations migrate from the electrolysis region 152 and into the surrounding catholyte chamber 116 by passing through the sidewall 132 of the membrane 128. The lithium ions can collect adjacent the cathode 122 and crude lithium metal can be collected from the catholyte chamber 116. In the examples illustrated herein, the activation electric potential may be 2.127V or greater to account to account for potential losses due to the apparatus, electrolyte and anode-cathode distance. The current density for the process may be between 0.75 $A/cm^2$ and about 4 $A/cm^2$.

As the crude lithium metal (one example of a metal product) that accumulates within the catholyte chamber 116 during operation is generally less dense than the catholyte material itself, the lithium metal product may tend to float toward an upper end or collection region 154 in the catholyte chamber 116 and an outlet material stream that includes some catholyte material and the metal product (lithium metal) can be withdrawn from the catholyte chamber 116 via the catholyte outlet 120. The outlet material stream can be stored, or preferably further processed to so that the crude lithium metal can then be separated from the catholyte material using any suitable separator 160 (such as a weir). Preferably, at least some of the catholyte material that is recovered from the outlet material stream (i.e. that has been withdrawn from the catholyte chamber) can be recycled back into the catholyte reservoir 148 via stream 162, and the crude lithium metal can be collected in a product stream 164.

As the process continues, anolyte material that is now relatively low in lithium carbonate (as the feedstock material is consumed via the electrolysis process) can then exit the electrolysis region 152 and flow into the upper portion of the anolyte chamber 104 and then out via the anolyte outlet 108. Optionally, this feedstock-depleted anolyte material can be recycled into the anolyte reservoir 140 where new feedstock material can be introduced.

Preferably, the hydrostatic pressure in the interior of the catholyte chamber 116 can be maintained at a first, catholyte pressure while the cell 100 is in use, while the pressure in the anolyte flowpath and chamber 104 is at a second, anolyte pressure that is optionally equal to or less than the catholyte pressure, and preferably is less than the catholyte pressure. This pressure difference can be carried by the membrane sidewall 132 and results in a net, generally inward net pressure gradient in the example illustrated (illustrated using arrows 156). Under these conditions, if any of the catholyte and/or anolyte material is able to seep through the sidewall 132 there will be a inward flux of catholyte material through the sidewall 132, flowing exclusively from the catholyte chamber 116 into the electrolysis region 152 of the anolyte chamber 104. Also, it is believed that these pressure-based effects may be effective because the hydrostatic pressure gradient may be sufficient to overcome the relatively weaker osmatic or local flow pressure differences that may tend to urge the non-metal ions or other impurities toward the catholyte chamber 116. These pressure effects have been observed to have less impact on the migration of the target metal ions (e.g. lithium ions) than the non-metal ions (e.g. carbonate ions). This may be at least in part because the positively-charged metal ions are urged relatively strongly toward the cathode due to the electromagnetic fields, while the non-metal, negatively-charged ions are not urged toward the cathode chamber as strongly.

This inhibition on the migration of non-metal ions into the catholyte chamber and/or any net flux of catholyte material into the anolyte chamber may help flush dissolved oxides and carbonates through the membrane 128 and may help prevent oxides and other impurities from accumulating with the catholyte chamber 116. This may help reduce fouling of the membrane 128 and the catholyte chamber 116.

The pressure difference between the catholyte chamber 116 and anolyte chamber 104 may be selected to so as to be sufficient enough to help provide the desired flux of catholyte material while not damaging the membrane, causing an undesirably high outflow of catholyte material or otherwise interfering with the desired electrolysis reaction. In the illustrated example, the difference between the catholyte pressure and the anolyte pressure may be between about 1 and about 18 inches of water gauge, but may be more or less in other examples.

Preferably, a vent conduit 166 can be provided toward the upper end of the anolyte chamber 104 and can be in fluid communication with a head space 168 in the anolyte chamber 104. Anode gases that collect in the head space 168 can be withdrawn from the anolyte chamber 104 via the vent conduit and may be further processed or released. With the cell 100 being substantially sealed it may also be possible in some embodiments to use LiCl as the feedstock material, as anode gasses can be collected/sequestered within the head space 168 and can be withdrawn from the cell 100 for further treatment before being released to the atmosphere.

Preferably, the interior of the cell 100 is generally sealed and is isolated from the surrounding environment, and its sub-compartments are separated from each other. This can help prevent oxygen, moisture and other atmospheric contaminants from entering the cell 100. In addition, the upper end of the catholyte chamber 116 is preferably separated from the anolyte chamber 104. As the membrane 128 extends through the catholyte chamber 116 in the illustrated example, sealing the catholyte chamber 116 may include at least partial sealing around/against the membrane 128.

Figure 3:
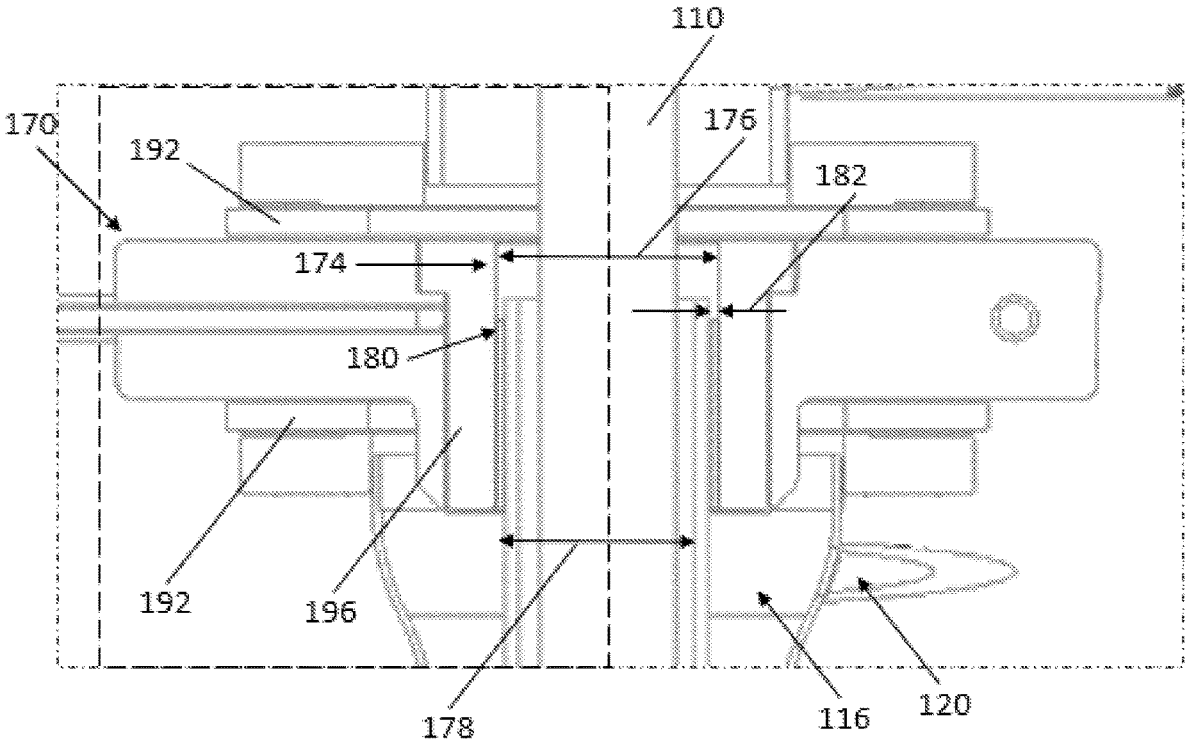
FIG. 3 is an enlarged view of a portion of FIG. 2*a;*
Figure 4:
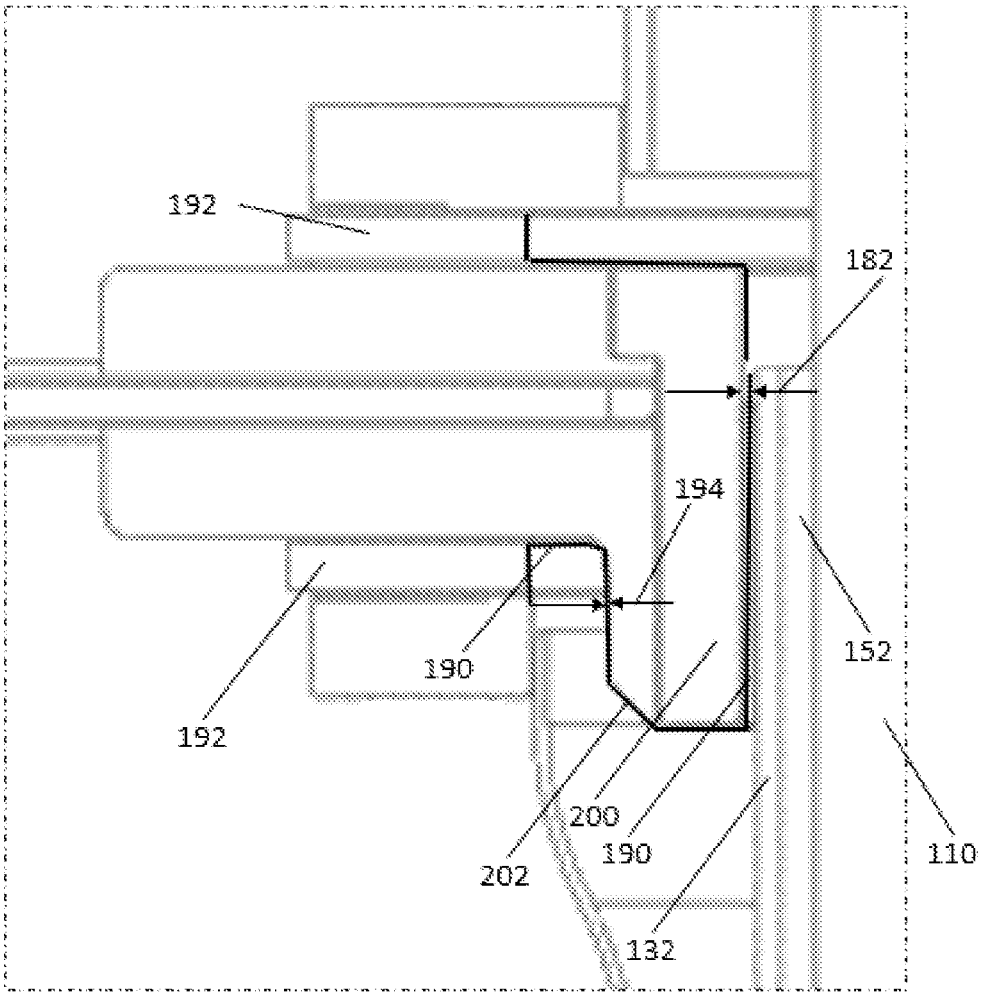
FIG. 4 is an enlarged view of a portion of FIG. 3.

Referring also to FIGS. 3 and 4, in the illustrated example the cell 100 includes an upper seal assembly 170 that can seal the upper end of the catholyte chamber 116. In this example, the seal assembly 170 is a generally self-healing, freeze seal in which a majority of the sealing face that is in contact with the membrane (and other portions of the interior of the catholyte chamber 116) is provided by frozen catholyte material, which impedes the flow/leakage of the molten catholyte material. Other types of seals may be considered in other embodiments of the present teachings.

In this example, the seal assembly 170 includes a body 172 that is shaped to cover the upper end of the catholyte chamber 116 and has a central aperture 174 that is sized to closely receive the membrane 128. Preferably, the aperture 174 has an aperture diameter 176 that is slightly greater than an outer diameter 178 of the membrane 128 such that an annular gap 180 is formed between the membrane 128 and the body 172. The gap 180 defines a gap width 182 that is selected such that it is capable of reliably being filled/sealed with frozen catholyte and/or anolyte material as described herein. In the illustrated example, the width 182 may be between about 1 and about 20 mm.

Preferably, the body 172 is maintained at a seal temperature that is less than the freezing temperature of the catholyte and/or anolyte material using a suitable cooling system. In this example, the body 172 is formed from a material with a relatively high thermal conductivity and is provided with an internal, fluid cooling conduit 184 through which a coolant fluid (such as water) can be circulated. This configuration can help ensure that substantially all of body 172 will be at approximately the same seal temperature, including its outward facing surfaces that are likely to be in contact with the molten catholyte. Suitable materials for the body 172 may include copper, aluminum, steel, stainless steel, cast iron, brass, bronze, nickel- or cobalt-based super-alloys, titanium or graphite and the like.

When the cell 100 is in operation, molten catholyte material can flow into contact with the surfaces of the body 172 that face and are exposed to the interior of the catholyte chamber 116. With the body 172 maintained at the seal temperature, molten catholyte material in contact with the body 172 surfaces can solidify/freeze thereby forming a skin or protective layer 190 of frozen catholyte material. This protective layer can protect the body 172 from exposure to the molten catholyte and may also provide at least some degree of thermal insulation for the body. The protective layer may build up to a generally steady state thickness 194, where its inner surface is cooled by the body 172 and its outer surface is generally at its melting point. The thickness 194 may vary based on the operating conditions of the cell, but may be between about 0.5 mm and about 25 mm. The build-up of frozen catholyte on the surface of the body 172 can fill the gap 180 between the body 172 and the membrane 128 and can seal the upper end of the catholyte chamber 116.

Preferably, the body 172 can include a protective collar portion 196 that extends axially further into the catholyte chamber 116 by a collar height 198 and that surrounds/covers the upper portion of the membrane 128. Preferably, the collar height 198 is set so that the collar portion 196 extends below the collection region 154 in which the crude lithium metal is expected to collect, and the lower end of the collar portion 196 is in contact with the catholyte material while the cell is in use. This can help reduce, and may prevent, contact between the crude lithium metal and the membrane 128, which may help prolong the membrane life. Alternatively, in some examples, the material used to provide the membrane 128 may be sufficiently robust to withstand contact with the crude lithium metal and molten catholyte material within the catholyte chamber for a suitable operating period. In some examples, the protective collar portion 196 may be smaller (i.e. may have a shorter axial extent than as illustrated in FIGS. 2*a* and 2*b*) or may be omitted entirely (such as shown in cell 1100), such that the side of the body 172 that is facing the catholyte chamber 116 is generally flat, and/or has generally the same configuration as the side of the body 172 that is facing the anolyte chamber.

The collar portion 196 may be of any suitable shape, and in the illustrated example includes a tapered distal portion 200 with an inclined outer surface 202. This arrangement may help provide space within the collection region 154 and may help provide desirable flow conditions with catholyte chamber 116, such as helping to promote flow of the crude lithium metal toward the outlet 120.

Upper portions of the body 172 that are exposed to the molten anolyte material can form their protective layer 190 from frozen anolyte material.

In this example, the seal assembly 170 can also electrically isolate the cathode 122 from the upper portion 126 of the housing 102. To help provide the desired isolation, non-conductive, isolating gaskets 192 are provided. The gaskets may be formed from Teflon® (PTFE), mica or other suitable materials. The isolating gaskets 192 may also provide thermal insulation between the body 192 and the surrounding portions of the housing 102. Frozen catholyte can also cover exposed portions of the gaskets 192 which can help protect them from exposure to the molten catholyte material.

Figure 5:
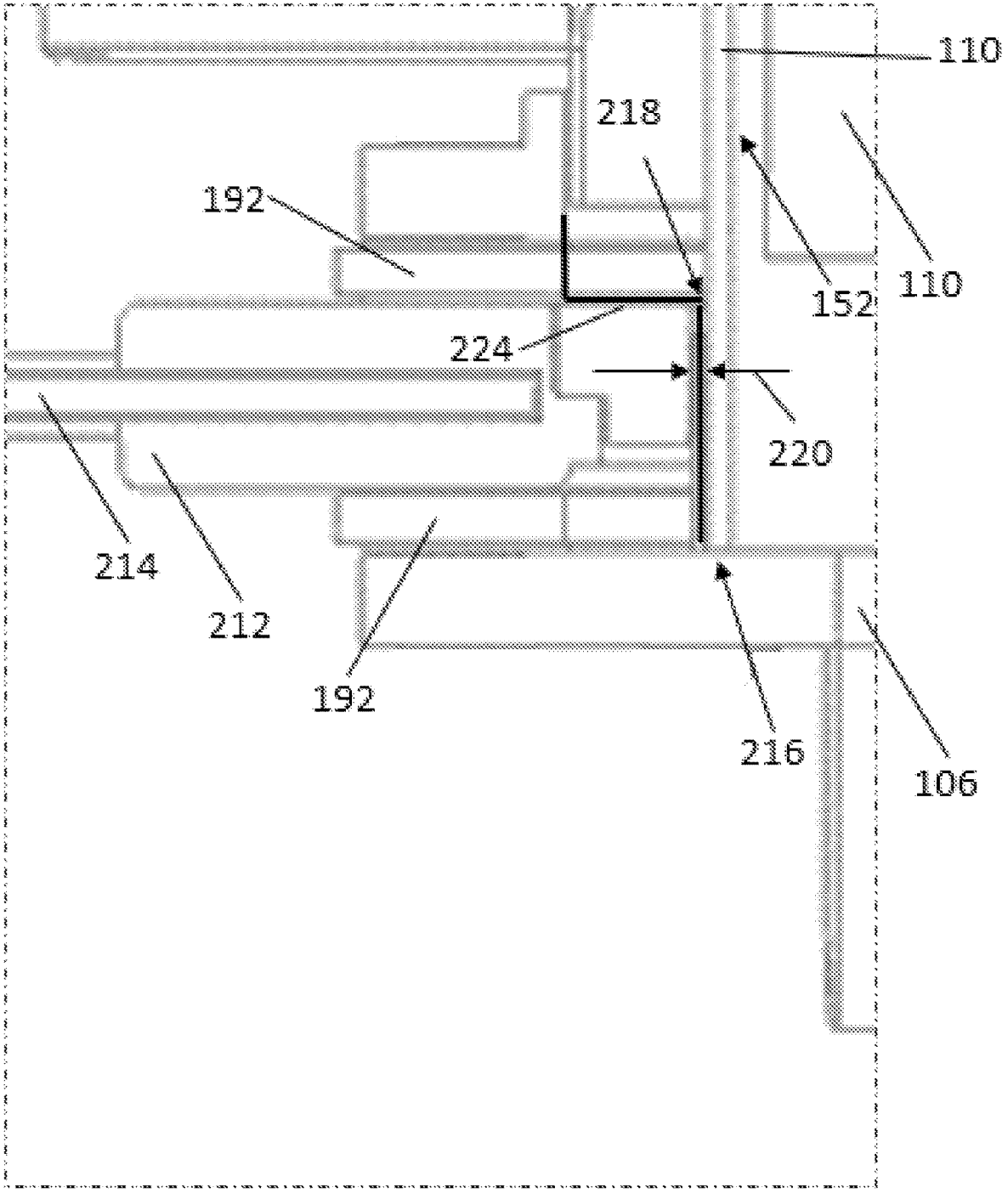
FIG. 5 is an enlarged view of another portion of FIG. 2*a;*

Referring also to FIG. 5, the cell 100 may also include a lower seal assembly 210 that is similar to the upper seal assembly 170 and is configured to seal the lower end of the catholyte chamber 116. In this example, the lower seal assembly 210 includes a body 212 formed from a suitably thermally conductive material and that includes embedded fluid cooling conduits 214. The body 212 includes an aperture 216 that is sized to receive the lower end of the membrane 128 while leaving an annular gap 218, having width 220. Gaskets 192 can be used to at least partially thermally and electrically insulate the body 212 from the other portions of the housing 102.

When the cell 100 is in use, a protective layer 224 of frozen catholyte material can cover and protect the surfaces of the body 212, and optionally gaskets 192, and can also freeze in the gap 218 between the body 212 and membrane 218 to seal the gap 218. The protective layers 190 may also help electrically isolate the bodies 172, 212 from the molten electrolytes and other cell components.

Figure 7:
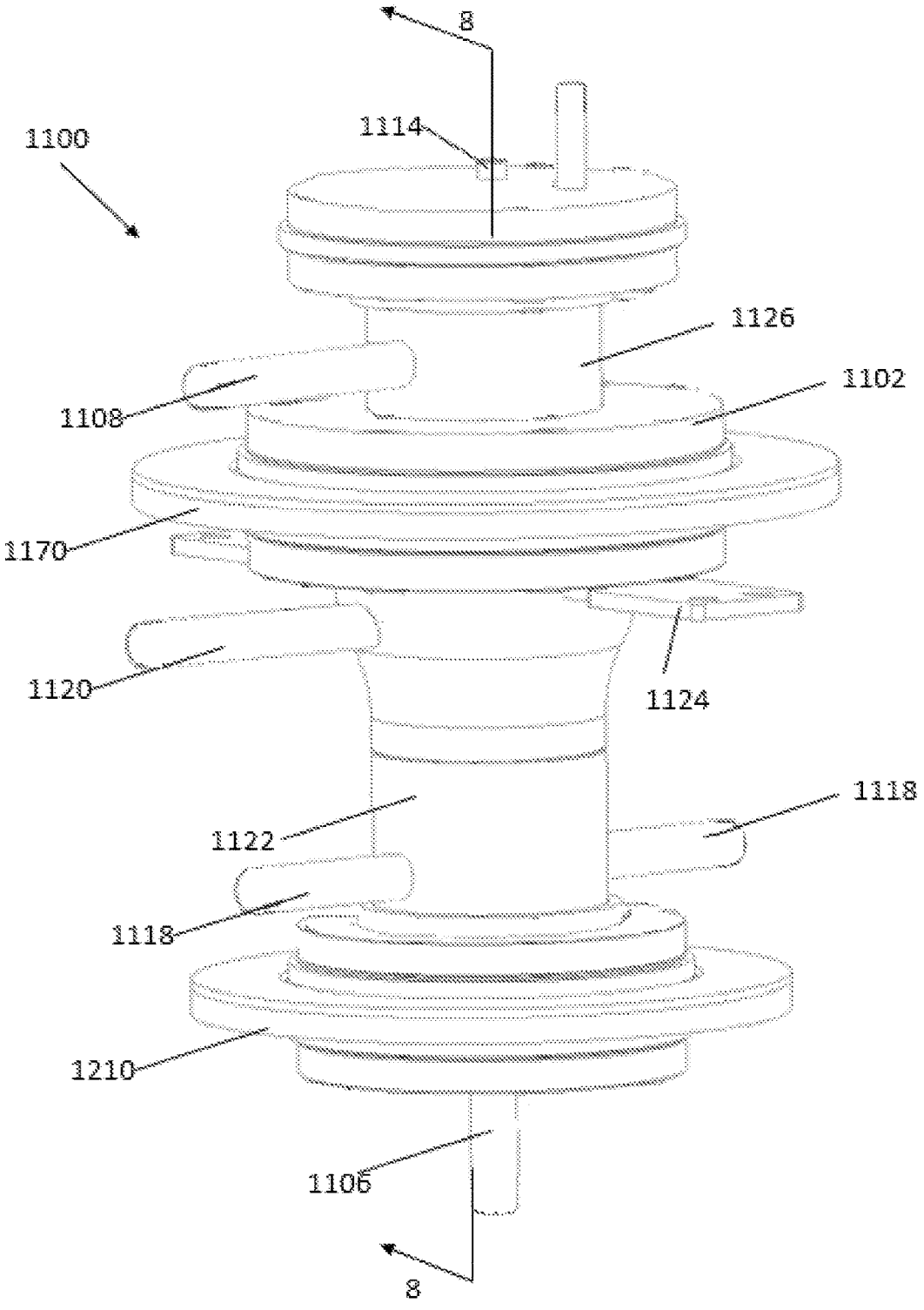
FIG. 7 is a perspective view of another example of a flow-through electrowinning cell.
Figure 8A:
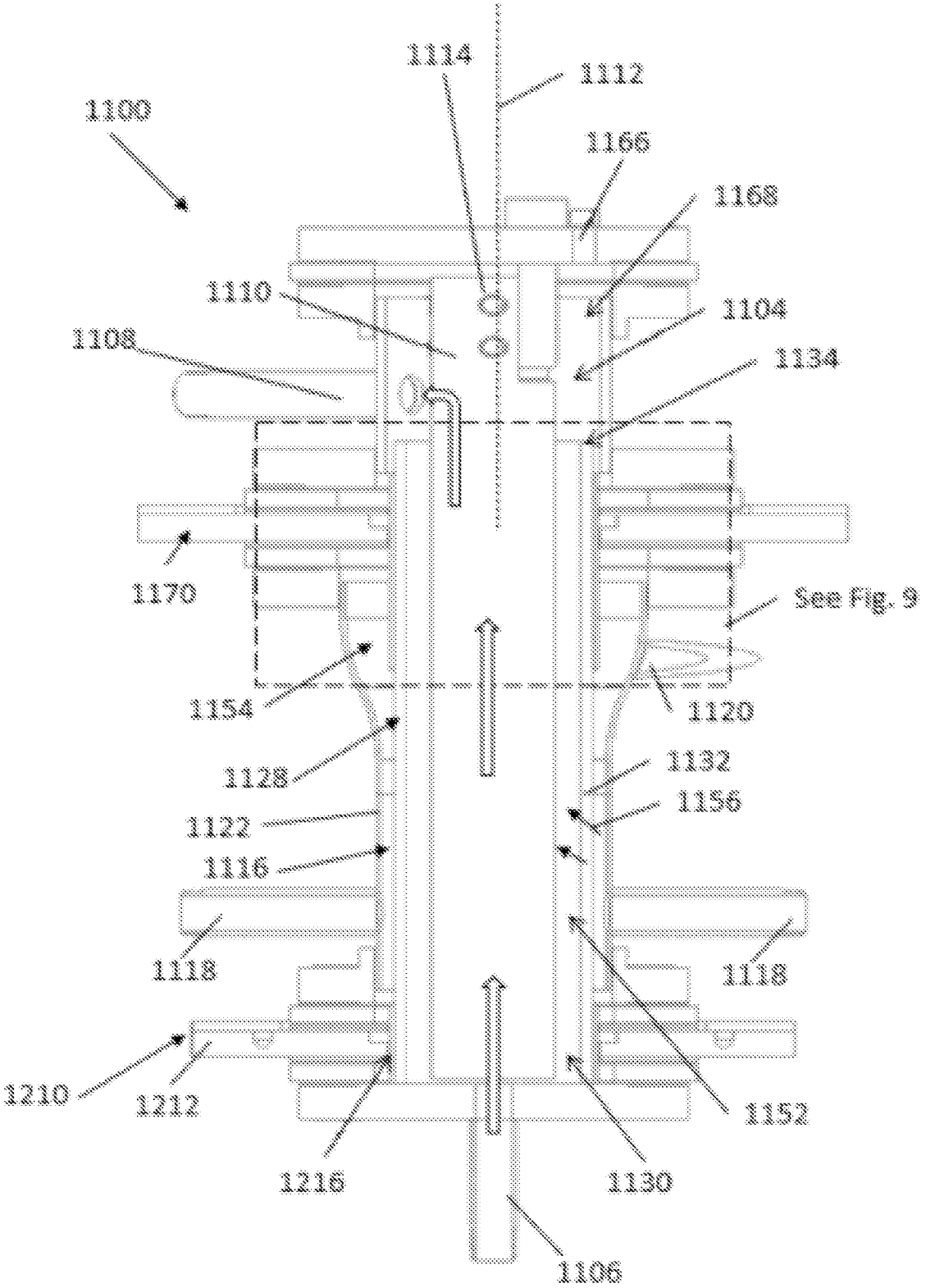
FIG. 8*a* is a side cross-sectional view of the electrowinning cell of FIG. 1, taken along line 8-8.
Figure 8B:
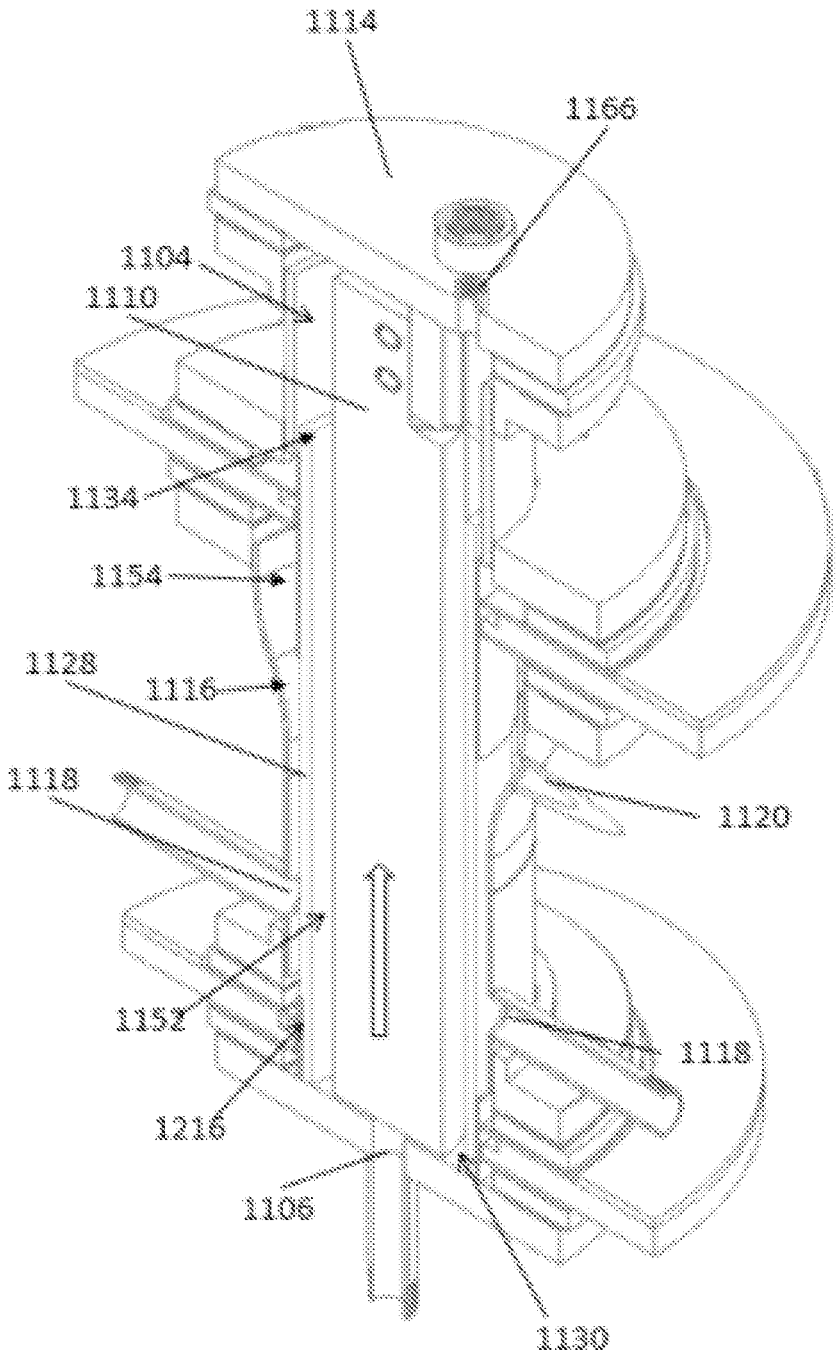
FIG. 8*b* is a perspective cross-sectional view of the electrowinning cell of FIG. 1, taken along line 8-8.

Referring to FIGS. 7-8*b*, another example of a flow-through cell 1100 that can be used to produce a target metal product (including a target metal or target metal alloy) from a suitable metal chemical feedstock (for example, to produce lithium metal from a lithium chemical feedstock) is illustrated. The cell 1100 has analogous features to the cell 100, with like features being annotated using like reference characters indexed by 1000.

In this example the cell 1100 includes a housing 1102 defining a cell interior that includes an anolyte chamber 1104 that is fluidly connected between an anolyte inlet 1106 and an anolyte outlet 1108. An elongated rod 1110 extends axially within the anolyte chamber 1104 in a direction that is generally aligned with the cell axis 1112 and acts as the anode. An anode connection 1114 is electrically connected to the anode 1110 and is connectable to a suitable power source.

The interior of the housing 1102 also includes a catholyte chamber 1116 that is in fluid communication with an associated catholyte inlet 1118 and catholyte outlet 1120. In this example, the catholyte chamber 1116 is at least partially bounded by an electrically conductive catholyte sidewall portion of the housing 1102, which functions as the cathode 1122 in this arrangement. The cathode sidewall section of the housing 1102 that functions as the cathode 1122 in this example is electrically isolated from an upper portion 1126 of the housing 1102 that functions as the anolyte chamber sidewall and helps bound the anolyte chamber 1104.

To help separate the interiors of the anolyte chamber 1104 and the catholyte chamber 1116 the cell includes an elongate, axially extending membrane 1128. In this example, the membrane 128 is configured as a generally hollow, elongate membrane tube having a lower end 1130 that is located toward a lower end of the housing 1102 and is in fluid communication with the anolyte inlet 1106, an axially extending sidewall 1132 that surrounds the anode 1110 and passes through the catholyte chamber 1116, and an opposing upper end 1134 that is outside the catholyte chamber 1116 and in fluid communication with an upper portion of the anolyte chamber 1104. In this arrangement, the interior of the membrane 1128 forms a first or lower part of the anolyte chamber 1104 and a portion of anolyte flow path through the cell 1100, and can help maintain a desired level of fluidic separation between the anolyte material flowing through the interior of the membrane 1128 and the catholyte material surrounding the outer surface of the membrane 1128.

When the cell 1100 is in use, the molten anolyte material, preferably containing a relatively high concentration of the lithium chemical feedstock ($Li_2CO_3$ in this example) is drawn from a suitable anolyte material reservoir and fed into the anolyte inlet 1106. Alternatively, a separate inlet could be provided and the lithium chemical feedstock could be fed directly into the chamber 1104 without first pre-mixing with the anolyte material. As the anolyte material flows along its anolyte flow path through the cell 1100 (including at least a portion of the anolyte flow path that is provided by the interior of the anolyte chamber 1104 including the interior of the membrane 1128 as well as the anolyte inlet 1106 and outlet 1108), catholyte material is drawn from a suitable catholyte reservoir 1148 and fed into the catholyte chamber 1116 via the catholyte inlet 1118.

In this example, a substantially annular portion of the anolyte chamber 1104 that is disposed radially between the anode 1110 and the cathode 1122 can define an electrolysis region 1152. In this example, the membrane 1128 has a relatively larger diameter than the membrane 128 described above. In this arrangement, the electrolysis region 1152 is narrower than the electrolysis region 152 described above. When an activation electric potential that is sufficient to initiate electrolysis of the lithium carbonate feedstock material is applied between the anode 1110 and cathode 1122 the lithium carbonate feedstock material flowing generally axially through the electrolysis region 1152 can be electrolyzed such and lithium cations migrate from the electrolysis region 1152 and into the surrounding catholyte chamber 1116 by passing through the sidewall 1132 of the membrane 1128. The lithium ions can collect adjacent the cathode 1122 and crude lithium metal can be collected from the catholyte chamber 1116.

As the crude lithium metal (one example of a metal product) that accumulates within the catholyte chamber 1116 during operation is generally less dense than the catholyte material itself, the lithium metal product may tend to float toward an upper end or collection region 1154 in the catholyte chamber 1116 and can be withdrawn from the catholyte chamber 1116 with the catholyte material via the catholyte outlet 1120. The crude lithium metal can then be separated from the catholyte material using any suitable separator (such as a weir), from which catholyte material can be recycled back into the catholyte reservoir and the crude lithium metal can be collected in a product stream.

A vent conduit 1166 can be provided toward the upper end of the anolyte chamber 1104 and can be in fluid communication with a head space 1168 in the anolyte chamber 1104. Anode gases that collect in the head space 1168 can be withdrawn from the anolyte chamber 1104 via the vent conduit and may be further processed or released.

Figure 9:
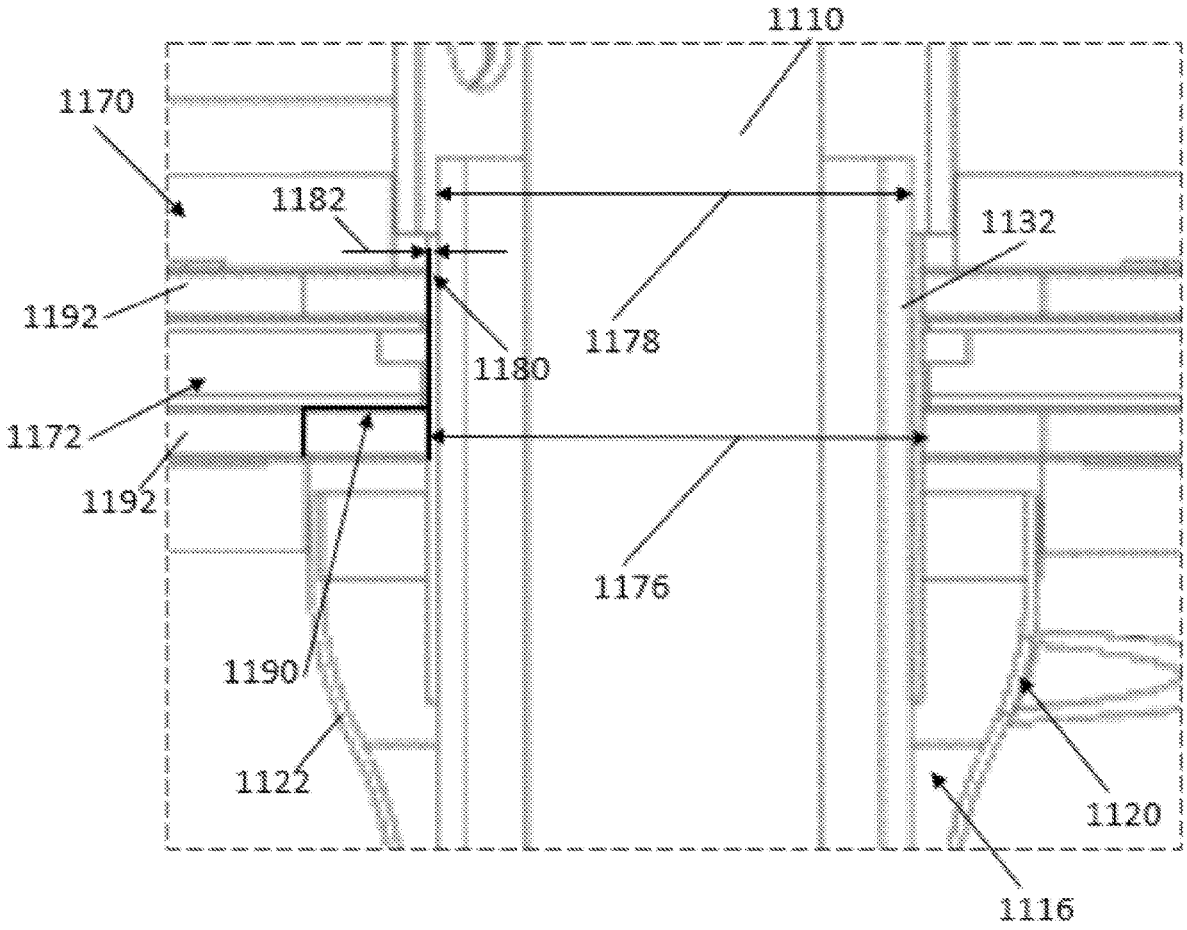
FIG. 9 is an enlarged view of a portion of FIG. 8*a;*

Referring also to FIG. 9, in the illustrated example the cell 1100 includes an upper seal assembly 1170 that can seal the upper end of the catholyte chamber 1116. In this example, the seal assembly 1170 is a generally self-healing, freeze seal in which a majority of the sealing face that is in contact with the membrane (and other portions of the interior of the catholyte chamber 1116) is provided by frozen catholyte material, which impedes the flow/leakage of the molten anolyte material into the catholyte chamber. Other types of seals may be considered in other embodiments of the present teachings.

In this example, the seal assembly 1170 includes a body 1172 that is shaped to cover the upper end of the catholyte chamber 1116 and has a central aperture 1174 that is sized to closely receive the membrane 1128. Preferably, the aperture 1174 has an aperture diameter 1176 that is slightly greater than an outer diameter 1178 of the membrane 1128 such that an annular gap 1180 is formed between the membrane 1128 and the body 1172. The gap 1180 defines a gap width 1182 that is selected such that it is capable of reliably being filled/sealed with frozen catholyte and/or anolyte material as described herein.

The body 1172 is formed from a material with a relatively high thermal conductivity and is provided with an internal, fluid cooling conduit 1184 through which a coolant fluid (such as water) can be circulated. This configuration can help ensure that substantially all of the body 1172 will be at approximately the same seal temperature, including its outward facing surfaces that are likely to be in contact with the molten catholyte.

When the cell 1100 is in operation, molten catholyte material can flow into contact with the surfaces of the body 1172 that face and are exposed to the interior of the catholyte chamber 1116. With the body 1172 maintained at the seal temperature, molten catholyte material in contact with the body 1172 surfaces can solidify/freeze thereby forming a skin or protective layer 1190 of frozen catholyte material. This protective layer can protect the body 1172 from exposure to the molten catholyte and may also provide at least some degree of thermal insulation for the body. The protective layer may build up to a generally steady state thickness 1194, where its inner surface is cooled by the body 1172 and its outer surface is generally at its melting point. The build-up of frozen catholyte on the surface of the body 1172 can fill the gap 1180 between the body 1172 and the membrane 1128 and can seal the upper end of the catholyte chamber 1116.

In contrast to body 172, the body 1172 has a generally flat or planar lower surface that faces the catholyte chamber 1116 and does not include a protective collar portion that extends axially further into the catholyte chamber 1116 to surround portions of the membrane 1128. This arrangement can be used in situations where the membrane is strong enough to resist exposure to the metal product within the catholyte chamber 1116 and in circumstances where the flow of the catholyte material through the chamber 1116 is generally continuous or ongoing removal of the outlet material stream such that the lithium metal product does not tend to stay in close proximity to the membrane 1128 for a material amount of time. This may help simplify the design of the body 1172 and may help reduce the impediments to the flow of the catholyte material within the chamber 1116 or out of the outlet 1120.

Upper portions of the body 1172, such as its upward facing anolyte sealing surface, that are exposed to the molten anolyte material can form their protective layer 1190 from frozen anolyte material, rather than catholyte material.

In this example, the seal assembly 1170 can also electrically isolate the cathode chamber sidewall that forms the cathode 1122 from the upper portion 1126 of the housing 1102. using non-conductive, isolating gaskets 1192 are provided.

The cell 1100 also includes an analogous lower seal assembly 1210 that is configured to seal the lower end of the catholyte chamber 1116. In this example, the lower seal assembly 1210 includes a body 1212 formed from a suitably thermally conductive material and that includes embedded fluid cooling conduits 1214. The body 1212 includes an aperture 1216 that is sized to receive the lower end of the membrane. 1128.

Figure 11:
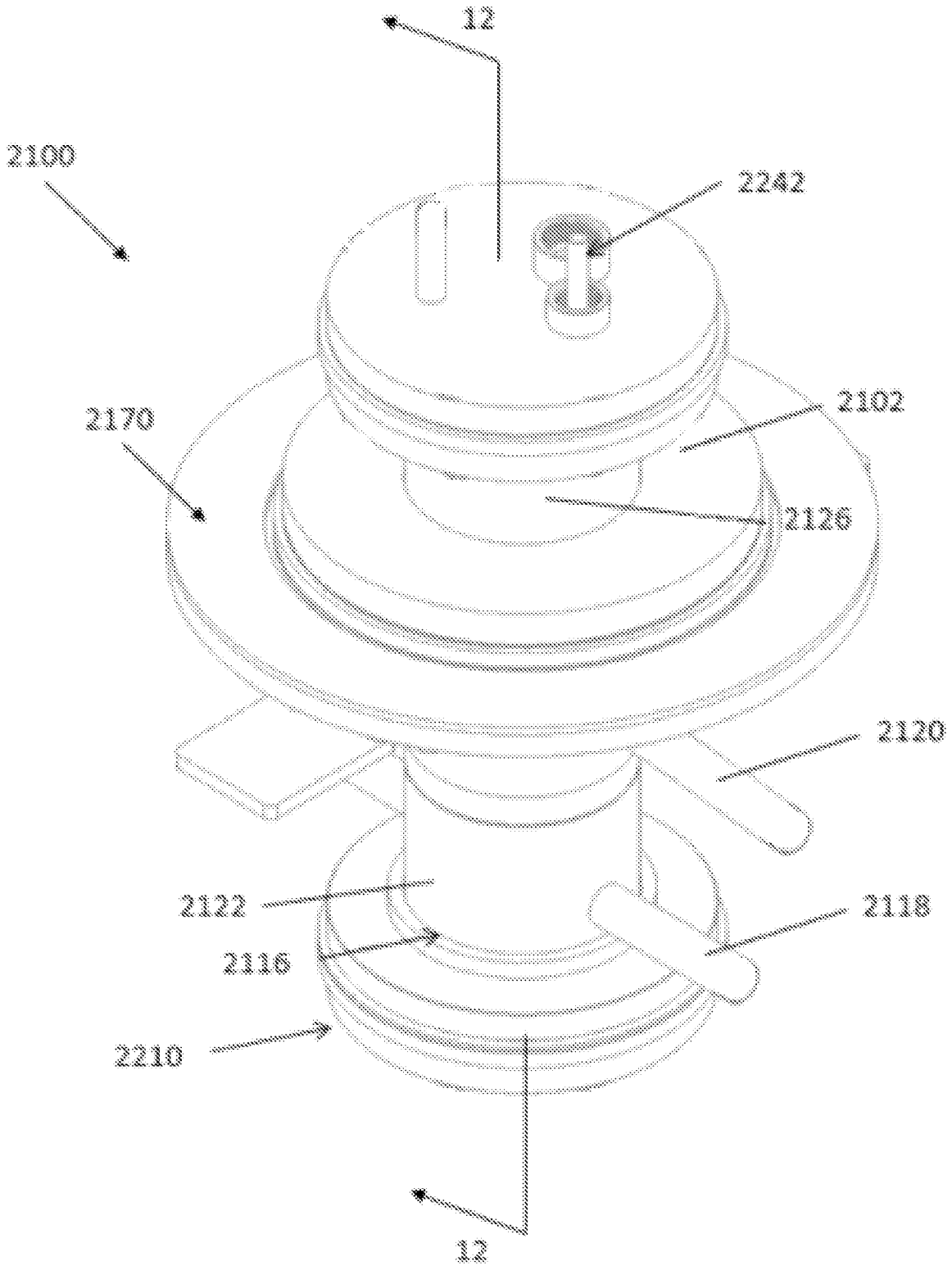
FIG. 11 is a perspective view of another example of a flow-through electrowinning cell.
Figure 12A:
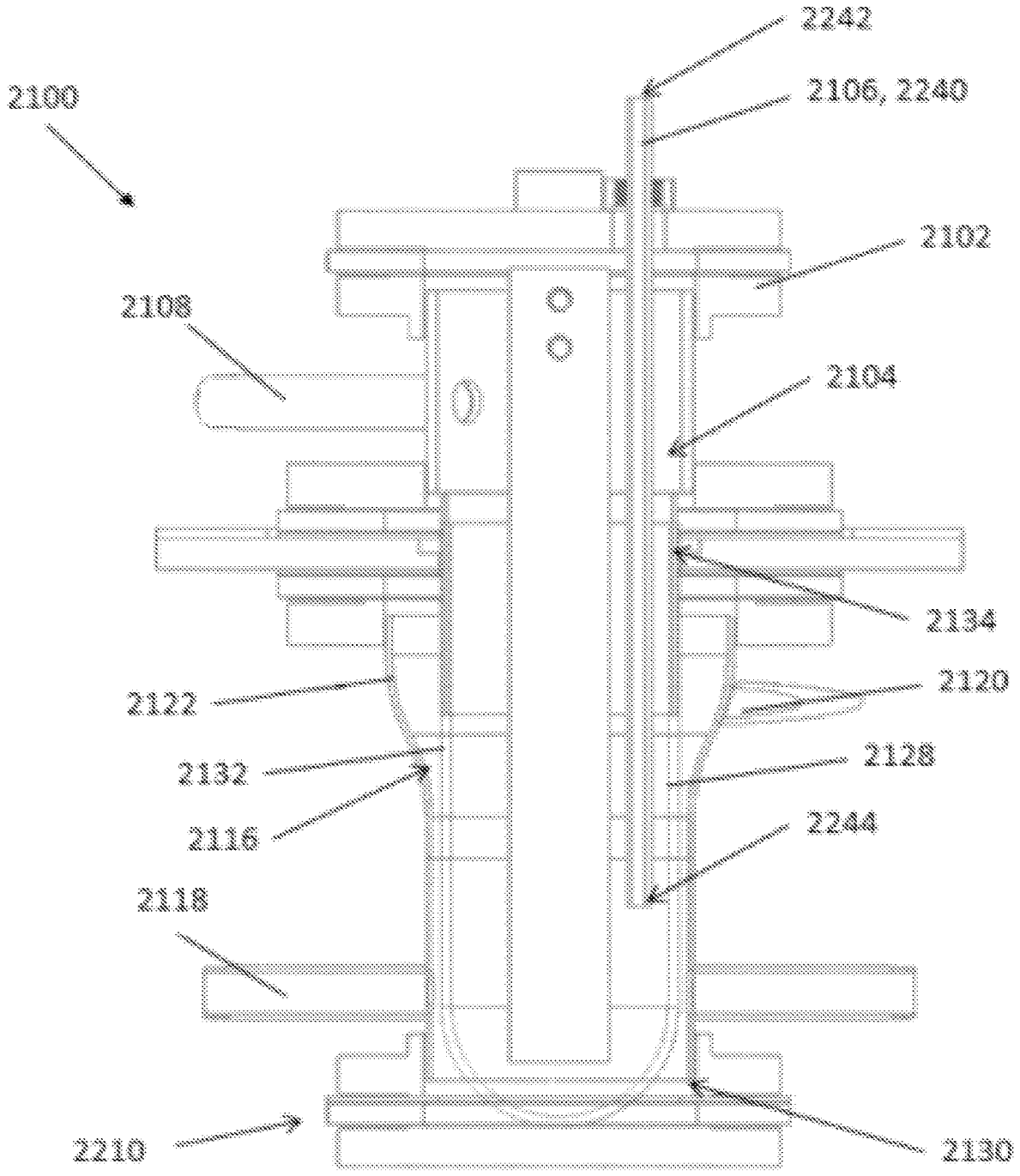
FIG. 12*a* is a side cross-sectional view of the electrowinning cell of FIG. 1, taken along line 12-12.
Figure 12B:
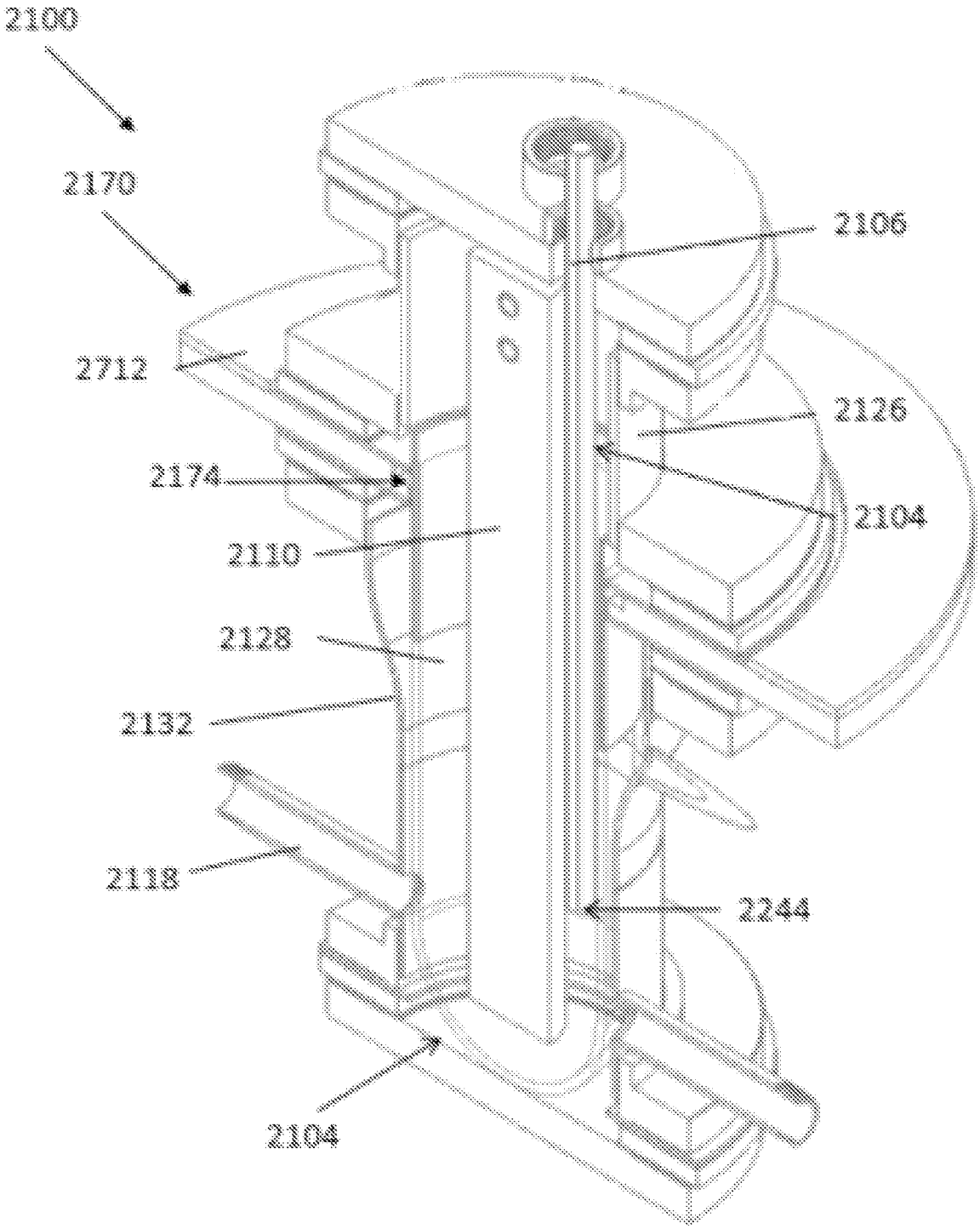
FIG. 12*b* is a perspective cross-sectional view of the electrowinning cell of FIG. 1, taken along line 12-12.

Referring to FIGS. 11-12*b*, another example of a flow-through cell 2100 that can be used to produce a target metal product (including a target metal or target metal alloy) from a suitable metal chemical feedstock (for example, to produce lithium metal from a lithium chemical feedstock) is illustrated. The cell 2100 has analogous features to the cell 100, with like features being annotated using like reference characters indexed by 2000.

In this example the cell 2100 includes a housing 2102 defining a cell interior that includes an anolyte chamber 2104 that is fluidly connected between an anolyte inlet 2106 and an anolyte outlet 2108. An elongate membrane 2128 extends axially within the housing and an elongate anode rod 2110 extends axially within the membrane 2128. In this example, the membrane 2128 is a closed-bottomed membrane, such that its lower end 2130 is closed with a generally hemi-spherical portion of membrane material (a flat bottom or other shapes are also possible), instead of being open. In this arrangement, the anolyte inlet 2106 includes a conduit 2240 having an upper end 2242 that is located to receive the anolyte material and a lower end 2244 that is located within the interior of the membrane 2128, and preferably in a lower portion of the membrane 2128, toward the closed lower end 2130). The anolyte material in this example exits the lower end 2244 of the inlet conduit 2240 and then travels up the interior of the membrane 2128 before reaching the upper portion of the anolyte chamber 2104 and exiting via the anolyte outlet 2108.

The interior of the housing 2102 also includes a catholyte chamber 2116 that is in fluid communication with an associated catholyte inlet 2118 and catholyte outlet 2120. In this example, the catholyte chamber 2116 is at least partially bounded by an electrically conductive catholyte sidewall portion of the housing 2102, which functions as the cathode 2122 in this arrangement. The cathode sidewall section of the housing 2102 that functions as the cathode 2122 in this example is electrically isolated from an upper portion 2126 of the housing 2102 that functions as the anolyte chamber sidewall and helps bound the anolyte chamber 2104.

As the crude lithium metal (one example of a metal product) that accumulates within the catholyte chamber 2116 during operation it can be withdrawn from the catholyte chamber 2116 with the catholyte material via the catholyte outlet 2120. The crude lithium metal can then be separated from the catholyte material using any suitable separator (such as a weir).

In the illustrated example the cell 2100 includes an upper seal assembly 2170 that can seal the upper end of the catholyte chamber 2116 and is analogous to the seal assemblies 170 and 1170 described herein. In this example, the seal assembly 2170 includes a body 2172 that is shaped to cover the upper end of the catholyte chamber 2116 and has a central aperture 2174 that is sized to closely receive the membrane 2128 as described herein.

When the cell 2100 is in operation, molten catholyte material can flow into contact with the surfaces of the body 2172 that face and are exposed to the interior of the catholyte chamber 2116. With the body 2172 maintained at the seal temperature, molten catholyte material in contact with the body 2172 surfaces can solidify/freeze thereby forming a skin or protective layer of frozen catholyte material. This protective layer can protect the body 2172 from exposure to the molten catholyte and may also provide at least some degree of thermal insulation for the body. Upper portions of the body 2172, such as its upward facing anolyte sealing surface, that are exposed to the molten anolyte material can form their protective layer from frozen anolyte material, rather than catholyte material. In this example, the seal assembly 2170 can also electrically isolate the cathode chamber sidewall that forms the cathode 2122 from the upper portion 2126 of the housing 2102 using non-conductive, isolating gaskets.

Unlike cells 100 and 1100, because the lower the lower end 2130 of the membrane 2128 is closed, the lower end of the catholyte chamber 2116 does not need to have an opening to provide the anolyte inlet or connect to the membrane 2128. Therefore, the lower seal assembly 2210 could optionally include a freeze flange that is analogous to assemblies 210 and 1210 described herein (without the need for an aperture). Alternatively, the lower seal assembly 2210 could be a metal plate or other such structure that can withstand exposure to the conditions within the catholyte chamber 2116 and optionally that need not be electrically isolated from the sidewall (and therefore could also form part of the cathode 2122).

Figure 10:
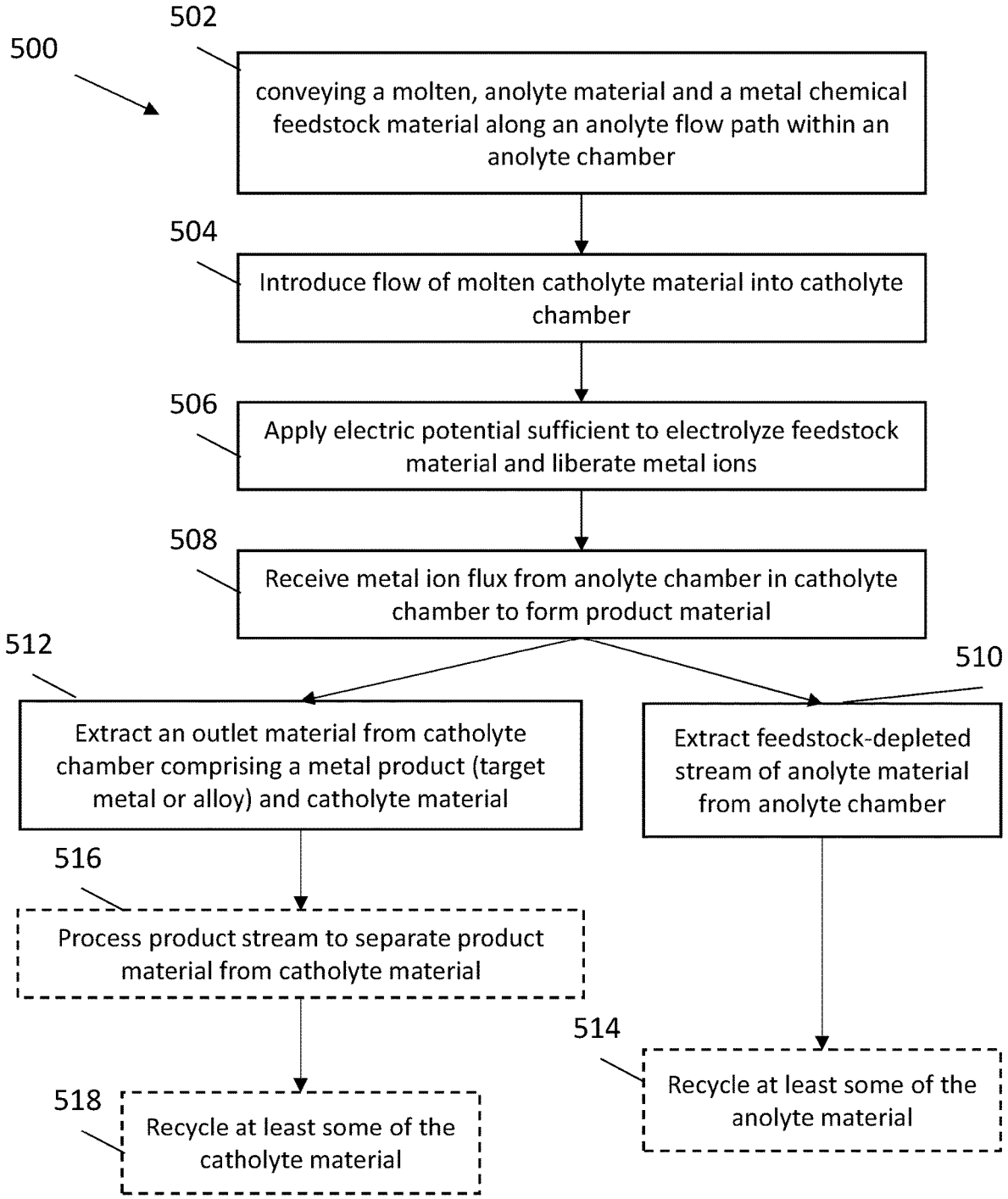
FIG. 10 is a flow chart illustrating one example of a method of electrowinning lithium using a flow-through electrowinning cell.

Referring to FIG. 10, one example of a process 500 for electrowinning a target metal (such as lithium) from a target metal feedstock (such as a lithium chemical feedstock material) using a flow-through electrowinning apparatus as described herein includes, at step 502, conveying a molten, anolyte material and a lithium chemical feedstock material along an anolyte flow path within an anolyte chamber (such as 104) containing an anode (such as 110). Step 504 then includes conveying a molten, catholyte material along a catholyte flow path within a catholyte chamber (such as 116) that has a cathode (such as sidewall cathode 122) and is at least partially fluidly isolated from the anolyte chamber via a separator assembly (such as 170) that includes a porous membrane (such as 128) configured to permit target metal ion migration between the anolyte chamber and the catholyte chamber.

In some examples wherein step 502 can include conveying the lithium chemical feedstock material and the anolyte material into the anolyte chamber via an anolyte inlet, and the process may include the optional step of providing an anolyte reservoir outside the anolyte chamber and so that step 502 can include conveying the anolyte material from the anolyte reservoir to the anolyte chamber via an anolyte supply conduit.

Optionally, to help facilitate the mixing of the materials the process can include the step of adding the lithium chemical feedstock material to anolyte material that is contained in the anolyte reservoir to create a feedstock-rich anolyte stream whereby step 502 can include conveying both the anolyte material and the lithium chemical feedstock material from the anolyte reservoir to the anolyte chamber via the anolyte supply conduit.

Preferably, the process includes maintaining the anolyte material and the lithium chemical feedstock at an operating temperature above the freezing temperature of the anolyte material, such as by heating the anolyte material and the metal chemical feedstock to the operating temperature before it enters the anolyte chamber. This can include providing a catholyte reservoir outside the catholyte chamber and conveying the catholyte material from the catholyte reservoir to the catholyte chamber via a catholyte supply conduit while it is warm. A suitable operating temperature that is preferably at least greater than the melting points of the catholyte, anolyte and feedstock material can be above 180, 200, 220, 240, 250, 270, 280, 300, 320, 340, 350, 360, 380, 400, 420, 440, 460, 480, 500, 600 degrees Celsius or more and may be less than about 700, 650, 600, 550, 500, 480, 460, 440, 420 degrees Celsius in some preferred examples.

Preferably, during steps 502-512 the process includes maintaining the catholyte material and anolyte materials at an operating temperature that is above their freezing temperatures.

With the catholyte and anolyte materials in their respective chambers, the process can include, at step 506 applying an activation electric potential between the anode and the cathode that is sufficient to electrolyze and separate metal (e.g. lithium) cations from the metal chemical feedstock material in the anolyte chamber, thereby causing a flux of metal cations to migrate through the porous membrane from the anolyte chamber to the catholyte chamber and a metal product to be formed in the catholyte chamber, at step 508.

While applying the activation electric potential, the process includes, at step 510, extracting a feedstock-depleted anolyte material from the anolyte chamber via an anolyte outlet and, at step 512 extracting an outlet material including the catholyte material and the metal product from the catholyte chamber via a catholyte outlet.

Optionally, at step 514, the process can include recycling at least a portion of the feedstock-depleted anolyte material extracted from the anolyte chamber back into the anolyte reservoir or into another suitable location in the process (such as into the anolyte chamber or into the anolyte flow path between the anolyte reservoir and the anolyte chamber).

Optionally, the process can include step 516 in which the outlet material is processed using a separator located outside the catholyte chamber to separate the lithium metal from a residual catholyte material in the outlet materials stream. This step can include processing the outlet material using a separator located outside the catholyte chamber to separate the lithium product alloy from a residual catholyte material.

Optionally, the catholyte material in the catholyte chamber can include a carrier metal that reacts with lithium in the catholyte chamber to form a lithium product alloy in situ within the catholyte chamber during step 506. In these examples the metal product produced at step 506 includes a metal product alloy (such as a lithium product alloy).

Optionally, the catholyte material entering the catholyte chamber already includes the carrier metal. For example, the process can include mixing the carrier metal with the catholyte material in the catholyte reservoir that is outside the catholyte chamber containing catholyte material, before the catholyte material is conveyed to the catholyte chamber.

Optionally, at step 518, the process can include recycling at least a portion of the residual catholyte material back into the catholyte reservoir or into another suitable location in the process (such as into the catholyte chamber or into the catholyte flow path between the catholyte reservoir and the catholyte chamber).

Preferably, steps 502 to 508 can include pressurizing the anolyte chamber to a first hydrostatic pressure and the catholyte chamber to a second hydrostatic pressure that is greater than the first pressure, whereby the flow or flux of either of the electrolyte materials through the membrane will be at least substantially, and preferably may be exclusively in one direction, from the catholyte chamber to the anolyte chamber through the porous membrane. This may help prevent unwanted materials, byproducts or contaminants that are present within the anolyte chamber from crossing the membrane into the catholyte chamber. This can also inhibit a counter flux of material through the membrane from the anolyte chamber to the catholyte chamber In this process, steps 502-510 can be conducted concurrently and/or can at least partially overlap with each other.

Testing was conducted using an apparatus similar to apparatus 100 shown in FIG. 1 to ensure molten salt would adequately flow through appropriate inlets and outlets. During this flow testing, electrolysis of the lithium chemical feedstock was not initiated but process conditions were similar in nature to what is expected in the production setup where electrolysis is expected to take place. The anolyte and catholyte flows consisted of material from the same reservoir in this test, with the molten reservoir material between 400 and 420 degrees Celsius. The test showed that anolyte and catholyte can flow through the apparatus as described herein.

The testing also demonstrated the application of a seal assembly that is an analogous to sealing assembly 170 described herein, and includes a body or sealing freeze flange that can be operated at seal temperature that was lower than the freezing temperature of the flowing materials used in the test. The freeze flange sealing assemblies were tested at a seal temperatures between 40 degrees Celsius and 60 degrees Celsius and this testing demonstrated that the assemblies do produce a layer of frozen electrolyte between the freeze flange and the membrane as described herein. This solidified, frozen electrolyte was shown to provide the required fluid isolation between the catholyte and anolyte chambers during electrolysis of the lithium chemical feedstock. Results of the test confirmed to the applicants that the continuous anolyte and catholyte streams will flow as desired through the cell and a layer of frozen electrolyte will form between the freeze flange and the membrane when coolant is circulated through the freeze flange. The extent of the frozen electrolyte generated may be adjusted by the length of the neck on the freeze flange, coolant flowrate, electrolyte temperature and environmental conditions.

In the examples described herein, the electrolyte material that is used to provide the catholyte and/or the anolyte can be any suitable material, and in the examples described herein is a molten salt that is flowable through the cells, if desired, and can include chloride, fluoride, iodide, bromide, sulphate, nitrate and carbonate salts, and mixtures thereof and similar salts of other metals to produce a relatively low-melting point lithium ion containing melt, such as for example LiCl—KCl, LiI—CsI or LiI—KI. Optionally, the electrolyte material may include at least one of, or a mixture of LiCl—KCl, LII-KI and LiI—CsI. In some examples, electrolyte material may be a eutectic mixture of LiCl—KCl, LII-KI and LiI—CsI, in which the concentrations are LiCl—KCl (60-40 mole %), LII-KI (54-46 mole %) and LiI—CsI (66.6-33.3 mole %), or are between 46% LiCl-54% KCl (by weight), 58.5% LII-41.5% KI (by weight) and 45.7% LiI-54.3% CsI (by weight). The catholyte and anolyte materials may have the same composition, or may have different compositions.

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. It is therefore contemplated that the appended claims will cover any such modifications or embodiments.

All publications, patents and patent applications referred to herein are incorporated by reference in their entirety to the same extent as if each individual publication, patent, or patent application was specifically and individually indicated to be incorporated by reference in its entirety.

We claim:

1. A flow-through electrowinning apparatus for electrowinning lithium from lithium carbonate and/or lithium hydroxide, the apparatus comprising:

an anolyte chamber configured to receive an anolyte material and lithium carbonate and/or lithium hydroxide and containing an anode, the anolyte chamber containing an anode and providing an anolyte flow path that extends between an anolyte inlet and an anolyte outlet, the anolyte flow path configured to receive, at the anolyte inlet, a flow comprising the anolyte material from an anolyte reservoir via an anolyte supply conduit and deliver, to the anolyte outlet, a flow comprising feedstock-depleted anolyte material;

a catholyte chamber having a cathode and providing a catholyte flow path extending between a catholyte inlet configured to receive a flow of catholyte material from a catholyte reservoir via a catholyte supply conduit and a catholyte outlet through which an outlet material stream comprising the catholyte material and a metal product exits the catholyte chamber; and a separator assembly that separates and electrically isolates the anolyte chamber and the catholyte chamber and includes a porous membrane configured to permit lithium ion migration between the anolyte chamber and the catholyte chamber when an activation electric potential that is sufficient to initiate electrolysis of lithium carbonate and/or lithium hydroxide within the anolyte chamber is applied between the anode and cathode;

wherein, when the apparatus is in use and the activation electric potential is applied the lithium carbonate and/or lithium hydroxide and the flow of anolyte material enters the anolyte chamber and the flow of catholyte material enters the catholyte chamber via the catholyte inlet; lithium cations separated from the lithium carbonate and/or lithium hydroxide migrate from the anolyte chamber to the catholyte chamber through the porous membrane, thereby depleting the amount of lithium carbonate and/or lithium hydroxide in the anolyte chamber and creating the lithium metal product within the catholyte chamber; and the flow of feedstock-depleted anolyte material exits the anolyte chamber via the anolyte outlet and the outlet material stream exits the catholyte chamber via the catholyte outlet, and wherein the anolyte chamber is at a first hydrostatic pressure and the catholyte chamber is at a second hydrostatic pressure that is greater than the first pressure, thereby causing a flux of catholyte material through the membrane from the catholyte chamber to the anolyte chamber and inhibiting a counter flux of material through the membrane from the anolyte chamber to the catholyte chamber.

2. The apparatus of claim 1, wherein the catholyte chamber is bounded by a catholyte sidewall that extends axially between a first end and an opposing second end;

wherein the membrane comprises an elongated membrane tube that extends axially from the first end of the catholyte sidewall into an interior of the catholyte chamber and wherein the anode extends axially within the elongated tube;

wherein the cathode comprises the sidewall of the catholyte chamber and laterally surrounds the anode;

the apparatus further comprising an anolyte sidewall that partially bounds the anolyte chamber and extends from a first end proximate the first end of the catholyte sidewall, to an opposing second end, and wherein the separator assembly is disposed between the first end of the catholyte sidewall and the first end of the anolyte sidewall and is configured to separate the catholyte chamber from the anolyte chamber and electrically isolate the catholyte sidewall from the anolyte sidewall; and wherein the anolyte sidewall and catholyte sidewall are part of a common housing containing the catholyte chamber and the anolyte chamber.

3. The apparatus of claim 2, wherein the separator assembly includes a first seal assembly configured to fluidly seal the first end of the catholyte sidewall, the first seal assembly comprising a body having a catholyte sealing surface.

4. The apparatus of claim 2, wherein the catholyte sealing surface carries a layer of frozen catholyte material.

5. The apparatus of claim 4, wherein the frozen catholyte material is disposed within a gap between the body and the first end of the elongated membrane tube, and wherein the frozen catholyte material fluidly seals the gap.

6. The apparatus of claim 4, further comprising an isolating gasket disposed between the body and the catholyte chamber, whereby the body is electrically insulated from the catholyte housing; and wherein the isolating gasket carries the layer of frozen catholyte material.

7. The apparatus of claim 2, further comprising a second seal assembly configured to fluidly seal the second end of the catholyte sidewall, wherein the second seal assembly is configured to seal a second end of the elongated membrane tube, and wherein the second end of the elongated membrane tube comprises the anolyte inlet.

8. The apparatus of claim 7, wherein the second seal assembly includes a catholyte sealing surface that carries a layer of frozen catholyte material.

9. The apparatus of claim 8, wherein the frozen catholyte material is disposed within a gap between the body and the second end of the elongated membrane tube, and wherein the frozen catholyte material fluidly seals the gap.

10. The apparatus of claim 1, wherein the catholyte material includes a LiCl—KCl eutectic.

11. The apparatus of claim 1, further including an anolyte heater external the anolyte chamber; and a catholyte heater external to the catholyte chamber.

12. The apparatus of claim 1, further comprising a chamber heater adapted to keep the anolyte chamber and/or the catholyte chamber at an operating temperature.

13. The apparatus of claim 1, wherein the catholyte material in the catholyte chamber comprises a carrier metal that reacts with lithium to form a product alloy in situ within the catholyte chamber.

14. A flow-through electrowinning apparatus for electrowinning lithium from lithium carbonate and/or lithium hydroxide, the apparatus comprising:

an anolyte chamber configured to receive an anolyte material and lithium carbonate and/or lithium hydroxide and containing an anode, the anolyte chamber containing an anode and providing an anolyte flow path that extends between an anolyte inlet and an anolyte outlet, the anolyte flow path configured to receive, at the anolyte inlet, a flow comprising the anolyte material from an anolyte reservoir via an anolyte supply conduit and deliver, to the anolyte outlet, a flow comprising feedstock-depleted anolyte material;

a catholyte chamber having a cathode and providing a catholyte flow path extending between a catholyte inlet configured to receive a flow of catholyte material from a catholyte reservoir via a catholyte supply conduit and a catholyte outlet through which an outlet material stream comprising the catholyte material and a metal product exits the catholyte chamber, the catholyte chamber is bounded by a catholyte sidewall that extends axially between a first end and an opposing second end and an anolyte sidewall that partially bounds the anolyte chamber and extends from a first end proximate the first end of the catholyte sidewall, to an opposing second end, the cathode comprises the sidewall of the catholyte chamber and laterally surrounds the anode and wherein the anolyte sidewall and catholyte sidewall are part of a common housing containing the catholyte chamber and the anolyte chamber; and a separator assembly that separates and electrically isolates the anolyte chamber and the catholyte chamber and that is disposed between the first end of the catholyte sidewall and the first end of the anolyte sidewall and is configured to separate the catholyte chamber from the anolyte chamber and electrically isolate the catholyte sidewall from the anolyte sidewall, the separator assembly includes a porous membrane configured to permit lithium ion migration between the anolyte chamber and the catholyte chamber when an activation electric potential that is sufficient to initiate electrolysis of lithium carbonate and/or lithium hydroxide within the anolyte chamber is applied between the anode and cathode, the membrane comprising an elongated membrane tube that extends axially from the first end of the catholyte sidewall into an interior of the catholyte chamber and wherein the anode extends axially within the elongated tube, the separator assembly includes a first seal assembly configured to fluidly seal the first end of the catholyte sidewall, the first seal assembly comprising a body having a catholyte sealing surface carrying a layer of frozen catholyte material;

wherein, when the apparatus is in use and the activation electric potential is applied the lithium carbonate and/or lithium hydroxide and the flow of anolyte material enters the anolyte chamber and the flow of catholyte material enters the catholyte chamber via the catholyte inlet; lithium cations separated from the lithium carbonate and/or lithium hydroxide migrate from the anolyte chamber to the catholyte chamber through the porous membrane, thereby depleting the amount of lithium carbonate and/or lithium hydroxide in the anolyte chamber and creating the lithium metal product within the catholyte chamber; and the flow of feedstock-depleted anolyte material exits the anolyte chamber via the anolyte outlet and the outlet material stream exits the catholyte chamber via the catholyte outlet.

15. The apparatus of claim 14, wherein the frozen catholyte material is disposed within a gap between the body and the first end of the elongated membrane tube, and wherein the frozen catholyte material fluidly seals the gap.

16. The apparatus of claim 14, further comprising an isolating gasket disposed between the body and the catholyte chamber, whereby the body is electrically insulated from the catholyte housing; and wherein the isolating gasket carries the layer of frozen catholyte material.

17. The apparatus of claim 14, further comprising a second seal assembly configured to fluidly seal the second end of the catholyte sidewall, wherein the second seal assembly is configured to seal a second end of the elongated membrane tube, and wherein the second end of the elongated membrane tube comprises the anolyte inlet.

18. The apparatus of claim 17, wherein the second seal assembly includes a catholyte sealing surface that carries a layer of frozen catholyte material.

19. The apparatus of claim 18, wherein the frozen catholyte material is disposed within a gap between the body and the second end of the elongated membrane tube, and wherein the frozen catholyte material fluidly seals the gap.

* * * * *